US008178484B2

(12) United States Patent
Schwarz et al.

(10) Patent No.: US 8,178,484 B2
(45) Date of Patent: May 15, 2012

(54) ANTI-MICROBIAL COMPOSITION COMPRISING A SILOXANE AND ANTI-MICROBIAL COMPOUND MIXTURE

(75) Inventors: Ulrich Schwarz, Manchester (GB); Stephen Brian Falder, Manchester (GB)

(73) Assignee: Byotrol PLC, Great Manchester (GB)

( * ) Notice: Subject to any disclaimer, the term of this patent is extended or adjusted under 35 U.S.C. 154(b) by 0 days.

(21) Appl. No.: 12/669,415

(22) PCT Filed: Jul. 17, 2008

(86) PCT No.: PCT/GB2008/002436

§ 371 (c)(1),
(2), (4) Date: Apr. 14, 2010

(87) PCT Pub. No.: WO2009/010749

PCT Pub. Date: Jan. 22, 2009

(65) Prior Publication Data

US 2010/0197748 A1 Aug. 5, 2010

(30) Foreign Application Priority Data

Jul. 17, 2007 (GB) ..... 0713799.5

(51) Int. Cl.
*C11D 3/48* (2006.01)
*C11D 9/36* (2006.01)

(52) U.S. Cl. ..... 510/384; 510/235; 510/237; 510/238; 510/391; 510/421; 510/422; 510/466; 510/504

(58) Field of Classification Search ..... 510/384, 510/235, 237, 238, 391, 421, 422, 466, 504
See application file for complete search history.

(56) References Cited

U.S. PATENT DOCUMENTS

| | | | | |
|---|---|---|---|---|
| 3,970,755 | A | | 7/1976 | Gazzard et al. |
| 4,173,643 | A | | 11/1979 | Law |
| 4,540,505 | A | | 9/1985 | Frazier |
| 4,637,890 | A | | 1/1987 | Crabtree et al. |
| 4,698,148 | A | | 10/1987 | Keane |
| 4,718,941 | A | | 1/1988 | Halverson et al. |
| 4,767,547 | A | * | 8/1988 | Straathof et al. ..... 510/517 |
| 4,788,176 | A | | 11/1988 | Wieserman et al. |
| 4,902,349 | A | | 2/1990 | Wakizaka et al. |
| 4,933,096 | A | * | 6/1990 | Demeyere et al. ..... 510/527 |
| 5,178,495 | A | | 1/1993 | Cameron |
| 5,196,029 | A | * | 3/1993 | Kawase et al. ..... 8/405 |
| 5,244,666 | A | | 9/1993 | Murley |
| 5,405,542 | A | * | 4/1995 | Trinh et al. ..... 510/517 |
| 5,529,690 | A | | 6/1996 | Pashley et al. |
| 5,538,667 | A | | 7/1996 | Hill et al. |
| 5,591,708 | A | | 1/1997 | Richter |
| 5,645,841 | A | | 7/1997 | Hill et al. |
| 5,651,959 | A | | 7/1997 | Hill et al. |
| 5,665,374 | A | | 9/1997 | Hill et al. |
| 5,670,055 | A | | 9/1997 | Yu et al. |
| 5,681,637 | A | | 10/1997 | Kessler et al. |
| 5,688,449 | A | | 11/1997 | Fox |
| 5,711,936 | A | | 1/1998 | Hill et al. |
| 5,730,967 | A | | 3/1998 | Hill et al. |
| 5,733,529 | A | | 3/1998 | Hill et al. |
| 5,733,536 | A | | 3/1998 | Hill et al. |
| 5,753,214 | A | * | 5/1998 | Yoshioka et al. ..... 424/70.2 |
| 5,830,447 | A | * | 11/1998 | Hutchins et al. ..... 424/70.12 |
| 5,834,114 | A | | 11/1998 | Economy et al. |
| 5,856,245 | A | | 1/1999 | Caldwell et al. |
| 5,869,071 | A | | 2/1999 | Wieselman et al. |
| 5,869,172 | A | | 2/1999 | Caldwell |
| 5,874,164 | A | | 2/1999 | Caldwell |
| 5,888,488 | A | * | 3/1999 | Fukuchi ..... 424/70.12 |
| 5,955,093 | A | | 9/1999 | Woo et al. |
| 6,013,683 | A | * | 1/2000 | Hill et al. ..... 516/67 |
| 6,030,936 | A | | 2/2000 | Lu et al. |
| 6,039,965 | A | | 3/2000 | Donlan et al. |
| 6,080,706 | A | | 6/2000 | Blanvalet et al. |
| 6,107,268 | A | | 8/2000 | Yahiaoui et al. |
| 6,121,224 | A | | 9/2000 | Fonsny et al. |
| 6,177,399 | B1 | * | 1/2001 | Mei et al. ..... 510/466 |
| 6,645,480 | B2 | * | 11/2003 | Giles ..... 424/70.2 |
| 6,656,923 | B1 | | 12/2003 | Trinh et al. |
| 6,806,248 | B2 | * | 10/2004 | Grainger et al. ..... 510/527 |
| 8,003,593 | B2 | | 8/2011 | Schwarz et al. |
| 2003/0031687 | A1 | | 2/2003 | Falder et al. |
| 2003/0073600 | A1 | | 4/2003 | Avery et al. |
| 2003/0152644 | A1 | * | 8/2003 | Modak et al. ..... 424/667 |
| 2003/0220217 | A1 | * | 11/2003 | McHattie et al. ..... 510/327 |

(Continued)

FOREIGN PATENT DOCUMENTS

CA 1087955 A1 10/1980

(Continued)

OTHER PUBLICATIONS

Colloid from Wikipedia, the free encyclopedia, http://en.wikipedia.org/wiki/Colloid, Mar. 16, 2010.

PCT International Search Report, ISA/European Patent Office, mailed Jan. 29, 2009, actual completion of the international search Jan. 20, 2009, date of publication of the international search report Feb. 4, 2009, International Application No. PCT/GB2008/002436, International Filing Date Jul. 17, 2008, Byotrol PLC.

Abstract of JP 7179890 (A), Jul. 18, 1995, Olympus Optical Co—espacenet—Bibliographic data.

Abstract of Japanese Patent JP9175904 entitled Improved Water-Based Suspended Agrochemical Composition, published Aug. 7, 1997.

Abstract of Japanese Patent JP4065409A2 entitled Surface-Modifying Agent for Polymeric Material Curable With Actinic Energy Ray and Production Thereof issued Mar. 2, 1992.

(Continued)

*Primary Examiner* — Charles Boyer

(74) *Attorney, Agent, or Firm* — Nelson Mullins Riley & Scarborough, LLP

(57) ABSTRACT

The present invention provides an anti-microbial composition comprising (i) an antimicrobial agent with surfactant properties; (ii) a siloxane selected from those having the formulae $(H_3C)[SiO(CH_3)_2]_nSi(CH_3)_3$, and $(H_3C)[SiO(CH_3)H]_nSi(CH_3)_3$, and mixtures thereof, wherein n is from 1 to 24; and (iii) a polar solvent; wherein the ratio of (i) to (ii) is from about 100:1 to about 5:1.

31 Claims, No Drawings

U.S. PATENT DOCUMENTS

| | | | | |
|---|---|---|---|---|
| 2004/0102350 | A1* | 5/2004 | Baker et al. | 510/405 |
| 2006/0018847 | A1* | 1/2006 | Kroepke et al. | 424/59 |
| 2007/0020342 | A1* | 1/2007 | Modak et al. | 424/642 |
| 2007/0196291 | A1* | 8/2007 | Sakuta | 424/59 |
| 2008/0027172 | A1* | 1/2008 | Gee et al. | 524/837 |
| 2008/0131389 | A1* | 6/2008 | Shibuya et al. | 424/70.5 |
| 2009/0069436 | A1* | 3/2009 | MacGregor | 514/635 |

FOREIGN PATENT DOCUMENTS

| | | | |
|---|---|---|---|
| DE | 3739711 | A1 | 8/1989 |
| EP | 0 181 182 | A2 | 5/1986 |
| EP | 0 206 028 | A1 | 12/1986 |
| EP | 0 233 954 | A2 | 9/1987 |
| EP | 0 340 938 | A1 | 11/1989 |
| EP | 0 513 637 | A2 | 11/1992 |
| EP | 1076088 | A1 | 2/2001 |
| EP | 1266652 | A1 | 12/2002 |
| GB | 991597 | | 5/1965 |
| GB | 991597 | A | 5/1965 |
| GB | 2102288 | A | 2/1983 |
| GB | 2 247 171 | A | 2/1992 |
| GB | 2346375 | A | 8/2000 |
| GB | 2374011 | A | 10/2002 |
| JP | 07-179890 | A | 7/1995 |
| WO | 91/07090 | A1 | 5/1991 |
| WO | 92/21320 | A1 | 12/1992 |
| WO | 93/10209 | A1 | 5/1993 |
| WO | 96/39249 | A1 | 12/1996 |
| WO | 98/35933 | A1 | 8/1998 |
| WO | 9962493 | A1 | 12/1999 |
| WO | 00/00024 | A1 | 1/2000 |
| WO | 0100777 | A1 | 1/2001 |
| WO | 0121755 | A1 | 3/2001 |
| WO | 01/64034 | A1 | 9/2001 |
| WO | 02062142 | A1 | 8/2002 |
| WO | 2009010749 | A2 | 1/2009 |
| WO | 2009037445 | A1 | 3/2009 |

OTHER PUBLICATIONS

Abstract of Japanese Patent JP4110329A2 entitled Surface Modifier for Active Energy Ray-Curable Polymer Material and Preparation Thereof issued Apr. 10, 1992.

Abstract of Japanese Patent JP57179522A2 entitled Deodorizing Filer for Air Conditioner issued Nov. 5, 1982.

Abstract of Japanese Patent JP7252177A2 entitled Surface Modifier and Method for Surface Modification Using the Same issued Oct. 3, 1995.

Abstract of Japanese Patent JP7292289A2 entitled Antibacterial Floor Coating Material and Coated Floor Surface issued Nov. 7, 1995.

Abstract of Japanese Patent JP9256217A2 entitled Polytetrafluoroethylene Fiber and Its Production issued Sep. 30, 1997.

Abstract of Japanese Patent JP10016158A2 entitled Antibacterial Biaxially Oriented Polypropylene Film issued Jan. 20, 1998.

Abstract of Japanese Patent JP10095468A2 entitled Container Made of Antibacterial Material issued Apr. 14, 1998.

Abstract of Japanese Patent JP10095469A2 entitled Storage Container for Medical Instrument and Medical Material issued Apr. 14, 1998.

Abstract of JP10095935A2 entitled Antimicrobial Interior Material issued Apr. 14, 1998.

Abstract of JP10152396A2 entitled Material Having Crystalline Oriented Membrane of Titanium Dioxide and Its Production issued Jun. 9, 1998.

Article published in PNAS May 22, 2001, vol. 98, No. 11, pp. 5981-5985 by Joerg C. Tiller, et al., entitled Designing surfaces that kill bacteria on contact.

Patents Directorate, United Kingdom Intellectual Property Office, Combined Search and Examination Report under Sections 17 and 18(3), Jan. 19, 2009, United Kingdom Application No. GB0817024.3, Applicant Byotrol PLC.

Patents Directorate, United Kingdom Intellectual Property Office, Examination Report under Section 18(3), Apr. 9, 2010, United Kingdom Application No. GB0817024.3, Applicant Byotrol PLC.

PCT Notification of Transmittal of the International Search Report and the Written Opinion of the International Searching Authority European Patent Office, mailed Mar. 5, 2009, date of actual completion of the international search Feb. 27, 2009, International Application No. PCT/GB2008/003149, International Filing date Sep. 17, 2008, Applicant Byotrol PLC.

United Kingdom Patents Directorate, Intellectual Property Office, Official Action: Patents Act 1977: Examination Report under Section 18(3), issued Oct. 22, 2010, GB Patent Application No. 0817024.3, Reference BYOCX/P41725GB.

United Kingdom Patents Directorate, Intellectual Property Office, Patents Act 1977: Patents Rules 2007 Notification of Grant: Patent Serial No. GB2453038, issued on Feb. 8, 2011, GB Patent Application No. 0817024.3, Reference BYOCX/P41725GB.

Federal Ministry of Commerce & Industry, Trade Marks, Patents & Designs Division, Patents Branch, Federal Secretariat, Garki, Abjua, Nigeria, Acceptance of Patent Notification, issued Jun. 15, 2010, on NG Patent Application No. NG/C/2010/304.

United States Patent and Trademark Office, Non-Final Office Action mailed Nov. 10, 2010, U.S. Appl. No. 12/678,668, filed Jun. 30, 2010, Ulrich Schwartz.

Response to Office Action, filed Mar. 10, 2011 with the United States Patent and Trademark Office, in response to the Non-Final Office Action mailed Nov. 10, 2010, U.S. Appl. No. 12/678,668, filed Jun. 30, 2010, Ulrich Schwartz.

United States Patent and Trademark Office, Non-Final Office Action mailed Aug. 16, 2011, U.S. Appl. No. 13/176,213, filed Jul. 5, 2011, Ulrich Schwarz.

United States Patent and Trademark Office, Non-Final Office Action mailed Jan. 4, 2012, U.S. Appl. No. 13/281,707, filed Oct. 26, 2011, Ulrich Schwartz.

Response to Office Action, filed Feb. 7, 2012 with the United States Patent and Trademark Office, in response to the Non-Final Office Action mailed Aug. 16, 2011, U.S. Appl. No. 13/176,213, filed Jul. 5, 2011, Ulrich Schwartz.

Akzo Nobel, Product Information, Surfactants, ARQUAD 16-29 Hexadecyltrimethylanmmonium chloride INCI Name Cetrimonlum Chloride CAS No. 112-02-7, ARQUAD is a registered trademark in many countries. Version: 0.2 Issued: Nov. 6, 2008 http://www.surfactants.akzonobel.com.

Kenya Industrial Property Institute, Substantive Examination (Section 44 and Regulation 28), date of invitation Jul. 7, 2011, Kenya Patent Application No. KE/P/2010/001059, filed Sep. 17, 2008, Applicant—Byotrol PLC.

State Intellectual Property Office of The People's Republic of China, First Office Action (PCT application entering into the national phase), date of issue Dec. 2, 2011, Chinese Patent Application No. 200880116123.4, Applicant—Byotrol PLC.

State Intellectual Property Office of The People's Republic of China, First Office Action (PCT application entering into the national phase), date of issue Mar. 30, 2011, Chinese Patent Application No. 200880107233.4, Applicant—Byotrol PLC.

United States Patent and Trademark Office, Supplemental Notice of Allowability, mailed Jul. 15, 2011, U.S. Appl. No. 12/678,668, filed Jun. 30, 2012, First Named Inventor—Ulrich Schwarz.

United States Patent and Trademark Office, Issue Notification, U.S. Appl. No. 12/678,668, filed Jun. 30, 2012 First Named Inventor—Ulrich Schwarz.

* cited by examiner

ANTI-MICROBIAL COMPOSITION COMPRISING A SILOXANE AND ANTI-MICROBIAL COMPOUND MIXTURE

CROSS REFERENCE TO RELATED APPLICATIONS

This application is the national phase, under 35 U.S.C. §371, of International Application No.: PCT/GB2008/002436 filed July 17, 2008, which designated the United States of America and which claimed priority to Great Britain Application No. GB 0713799.5 filed July 17, 2007. The present application claims the benefit of priority to and incorporates herein by reference, in their entireties, the disclosures of International Application No.: PCT/GB2008/002436 and Great Britain Application No. GB 0713799.5.

This invention relates to anti-microbial compositions and to formulations including the anti-microbial compositions.

Microorganisms are known to present health hazards due to infection or contamination. When microorganisms are present on the surface of a substrate they can replicate rapidly to form colonies. The microbial colonies form a coating on the substrate surface, which is known as a biofilm. Biofilms frequently consist of a number of different species of microorganisms which in turn can be more difficult to eradicate and thus more hazardous to health than individual microorganisms. Some microorganisms also produce polysaccharide coatings, which makes them more difficult to destroy.

Microorganisms attach themselves to substrates forming a biofilm comprising a "calyx" of polysaccharides and/or similar natural polymers as the affixing mechanism. Without this affixing point, the reproduction of the microorganism particularly bacteria cannot proceed, or is at least seriously impaired.

Biofilms form when microorganisms such as bacteria adhere to surfaces in aqueous environments and begin to excrete Extra cellular secretion, a slimy, glue-like substance that can anchor them to all kinds of materials such as metals, plastics, soil particles, medical implant materials and tissue. A biofilm can be formed by a single bacterial species but more often biofilms consist of several species of bacteria, as well as fungi, algae, protozoa, debris and corrosion products. Essentially, bacterial biofilms may form on any surface exposed to bacteria and some amount of water. Once anchored to a surface, biofilm microorganisms carry out a variety of detrimental or beneficial reactions (by human standards), depending on the surrounding environmental conditions.

Many anti-microbial agents that can destroy microorganisms which are present in a wide range of environments such as medical, industrial, commercial, domestic and marine environments are known. Many of the known anti-microbial agents have previously been included in compositions for use in various applications and environments.

The known anti-microbial agents and the compositions that contain these anti-microbial agents destroy microorganisms by a number of different mechanisms.

For example, many anti-microbial agents are poisonous to microorganisms and, therefore, destroy microorganisms with which they are contacted. Examples of this type of anti-microbial agent include hypochlorites (bleaches), phenol and compounds thereof, arsenene and salts of copper, tin and arsenic. However, such agents typically are highly toxic to humans and animals as well as to microorganisms. Consequently these anti-microbial agents are dangerous to handle, and specialist handling, treatment and equipment are therefore required in order to handle them safely. The manufacture and disposal of compositions comprising this type of anti-microbial agent can, therefore, be problematic. There can also be problems associated with the use of compositions containing this type of anti-microbial agent, particularly in consumer materials where it is difficult to ensure that they are used for designated purposes.

Herein, unless the context indicates otherwise, "toxicity" is intended to refer to toxicity to complex organisms such as mammals. References to "toxic" are to be construed accordingly.

Once the anti-microbial agents enter the environment they can affect the health of life forms that they were not intended to affect. Furthermore, the anti-microbial agents are often highly stable and can cause environmental problems for long periods of time.

Other known anti-microbial agents that are commonly used include organic and inorganic salts of heavy metals such as silver, copper or tin. These salts produce toxic rinsates, which can cause problems to the environment. For example, the rinsates of such salts are poisonous to aquatic life. Again, once the toxic compounds enter the environment they are not easily broken down and can cause persistent problems.

Other anti-microbial agents currently in use include antibiotic type compounds. Antibiotics disrupt the biochemistry within microorganisms, for example by selectively diluting solutions to destroy or inhibit the growth of harmful microorganisms. Although antibiotics are effective, it is currently believed that they may selectively permit the development of resistant strains of the species that they are used against. These resistant strains are then able to reproduce unimpeded by the use of known antibiotics. Thus, there is a growing concern that wide and uncontrolled use of antibiotic materials in the wider environment, as opposed to their controlled use in medical contexts, could produce significant long-term risks.

Another method of microbial control is the use of oxidising agents in materials, such as household bleach. Which can be based on hypochlorite or peroxides such as hydrogen peroxide These materials are effective in a wet environment for sterilization and cleansing. However, the materials do not provide long-term passive anti-microbial control and sanitisation. By "passive control" we mean that the substrate counters microbial infection on its own by some property within it even in a dry environment, so that it does not require a cleaning regime to be effective at controlling microorganisms.

Another method involves the use of materials such as quaternary ammonium compounds that act as lytic (bursting) agents for the microbial cells. This method has the disadvantage of not being effective against all strains of microorganism so that resilient colonies can develop that have a high degree of "survivability" to disinfection with quaternary ammonium compounds so that they need to be alternated in use. Additionally, these materials are highly water soluble so easily wash away or can easily contaminate moist materials in contact with them.

The present invention provides an anti-microbial composition which addresses the foregoing deficiencies.

The anti-microbial compositions of the invention may provide a residual anti-microbial effect and/or an enhanced kill rate when they are applied to a surface and/or they are effective at significantly lower concentration of ant-microbial agent than previously known compositions.

The composition of the invention comprises (i) an anti-microbial agent with surfactant properties; (ii) a siloxane selected from those having the formulae $(H_3C)[SiO(CH_3)_2]_n Si(CH_3)_3$, and $(H_3C)[SiO(CH_3)H]_nSi(CH_3)_3$, and mixtures thereof, wherein n is from 1 to 24; and (iii) a polar solvent.

The important thing for compositions of the invention to provide the required anti-microbial effect is not typically the concentration of the components in the final solution, rather it is the ratio the number of molecules of the components. This ratio will remain the same whether the composition is in a concentrated form or whether it is in a dilute (ready-to-use) form.

Typically, the ratio the number of molecules of the component (i) to the component (ii) ranges from about 100:1 to 5:1, preferably from about 90:1 to about 8:1, more preferably from about 80:1 to about 15:1, still more preferably from about 70:1 to about 25:1 or about 20:1, most preferably from about 40:1 to about 60:1, for example about 50:1.

By the term "anti-microbial" we mean that a compound or composition that kills and/or inhibits the growth of microbes (microorganisms). The term "microbiocidal" is used to refer to compounds or compositions that kill microbes. The compositions of the invention are anti-microbial and/or microbiocidal.

A microorganism or microbe is an organism that is microscopic (too small to be seen by the human eye). Examples of microorganisms include bacteria, fungi, yeasts, moulds, mycobacteria, algae spores, archaea and protists. Microorganisms are generally single-celled, or unicellular organisms. However, as used herein, the term "microorganisms" also include viruses.

Preferably, the compositions of the invention comprise at least one anti-microbial agent selected from anti-bacterial, anti-fungal, anti-algal, anti-sporal, anti-viral, anti-yeastal and anti-moldal agents and mixtures thereof. More preferably, the compositions of the invention comprise at least one anti-bacterial, anti-fungal and/or anti-moldal agent.

As used herein, the terms anti-bacterial, anti-fungal, anti-algal, anti-viral, anti-yeastal and anti-moldal agents are intended to refer to agents which inhibit the growth of the respective microorganisms but do not necessarily kill the microorganisms and agents which kill the respective microorganisms. Thus, for example, within the term anti-bacterial we include agents which inhibit the growth of bacteria but may not necessarily kill bacteria and bactericidal agents which do kill bacteria.

As the skilled person will appreciate, the word ending "cidal" as used in for example "bactericidal" and "fungicidal" is used to describe agents which kill the microorganism to which it refers. Thus in these examples, bactericidal refers to an agent that kills bacteria and fungicidal refers to an agent that kills fungus. Examples of bactericides include myobactericides and tuberculocides. Preferably, the compositions of the invention comprise at least one agent selected from bactericidal, fungicidal, algicidal, sporicidal, virucidal, yeasticidal and moldicidal agents and mixtures thereof. More preferably, the compositions of the invention comprise at least one bactericidal, virucidal, fungicidal and/or moldicidal agent.

The compositions of the invention are effective against a wide range of organisms, including Gram negative and Gram positive spore formers, yeasts, viruses.

By way of example, the microorganisms which the compositions of the present invention can be effective against include:

Viruses such as HIV-1 (AIDS Virus), Hepatatis B Virus (HVB), Hepatitis C Virus (HCV), Adenovirus, Herpes Simplex, Influenza, Respiratory Syncytial Virus (RSV), Vaccinia, Avian Influenza virus, Avian Bronchitis, Pseudorabies virus, Canine Distemper, Newcastle Disease, Rubella, Avian Polyomavirus, Feline leukemia, Feleine picornavirus, Infectious Bovine rhinotracheitis, Infectious Bronchitis (Avian IBV), Rabies, Transmissible gastroenteritis virus, Marek's Disease;

Funguses such as *Trichophyton mentagrophytes, Aspergillus niger, Candida albicans, Aspergillus flavus, Aspergillus fumigatus, Trichophyton interdigitale, Alternaria tenius, Fusarium oxysporum, Geotrichum candidum, Penicillium digitatum, Phytophthora infestans, Rhizopus nigricans, Trichoderma harzianum, Trichophyton interdigitale,*

Bacteria such as *Pseudomonas aeruginosa, Staphylococcus aureus, Salmonella choleraesuis, Acinetobacter baumannii, Brevibacterium ammoniagenes, Campylobacter jejuni, Enterobacter aerogenes, Escherichia coli, Klebsiella pneumoniae, Proteus mirabilis, Pseudomonas cepacia, Salmonella schottmuelleri, Salmonella typhi, Salmonella typhimurium, Serratia marcescens, Shigella dysenteriae, Shigella flexneri, Shigella sonnei, Staphyloccus epidermidis, Streptoccus faecalis, Streptoccus faecalis* (Vancomycin resistant), *Streptococcus pyogenes, Vibrio chlorae, Xanthomonas axonopodis* pv citri (Citrus canker), *Acinetobacter calcoaceticus, Bordetella bronchiseptica, Chlamydia psittaci, Enterobacter cloacae, Enterococcus faecalis, Fusobacterium necrophorum, Legionella pneumophila, Listeria monocytogenes, Pasteurella multocida, Proteus vulgaris, Salmonella enteritidis, Mycoplasma gallisepticum, Yersinia enterocolitica, Aeromonas salmonicida, Pseudomonas putida, Vibrio anguillarum.*

In particular, the compositions of the invention are effective against *P. aeruginosa* (ATCC 15442, PaFH72/a), *E. coli* (ATCC 10536, ECFH64/a, 0157:H7 (toxin producing strain), CCFRA/896, 0157:H7 (non-toxigenic strain), CCFAA/6896, ATCC 10538), *S. aureus* (including MRSA, (e.g. NCTC 12493 MRSA, ATCC 12493 MRSA), VISA, ATCC 6538, 5a FH73/a), *Entercoccus hirea* (ATCC 10541, EhFH 65/a), Feline Coronavirus (SARS surrogate), Feline Calcivirus (Hum. Norovirus surrogate), *Salmonella typhimurium* (StFH 68/b), *Yersinia enterocolitica* (YE FH67/b), *Listeria monocytogenes* (Lm FH66/c), *Saccharomyces cerevisiae, Bacillus Subtilis* (ATCC 6633), *Bacillus stearothermophilus* (NCTC 10339), clostridium dificile (NCTC 11209), *Candida albicans* (ATCC 1023), *Aspergillus niger* (ATCC 16404), *Mycobacterium smegmatis* (TB stimulant).

By the term "anti-microbial agent with surfactant properties" (component (i)) we mean a material which can kill or inhibit the growth of microbes (microorganisms) and also has the effect of altering the interfacial tension of water and other liquids or solids and/or reduces the surface tension of a solvent in which it is used. More particularly, the anti-microbial agents with surfactant properties used in the present invention can kill or inhibit the growth of microbes and typically when introduced into water lower the surface tension of water.

A class of compounds that is particularly suitable for use as the anti-microbial agent with surfactant properties in the present invention is the class of compounds known as quaternary ammonium compounds, also know as "quats". These compounds typically comprise at least one quaternary ammonium cation with an appropriate anion. The quaternary ammonium cations are permanently charged, independent of the pH of their solution.

The structure of the cation can be represented as follows:

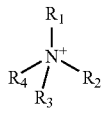

The groups $R_1$, $R_2$, $R_3$ and $R_4$ can vary within wide limits and examples of quaternary ammonium compounds that have anti-microbial properties will be well known to the person of ordinary skill in the art.

Each group $R_1$, $R_2$, $R_3$ and $R_4$ may, for example, independently be a substituted or unsubstituted and/or straight chain or branched and/or interrupted or uninterrupted alkyl, aryl, alkylaryl, arylalkyl, cycloalkyl, (aromatic or non-aromatic) heterocyclyl or alkenyl group. Alternatively, two or more of $R_1$, $R_2$, $R_3$ and $R_4$ may together with the nitrogen atom form a substituted or unsubstituted heterocyclic ring. The total number of carbon atoms in the groups $R_1$, $R_2$, $R_3$ and $R_4$ must be at least 4. Typically the sum of the carbon atoms in the groups $R_1$, $R_2$, $R_3$ and $R_4$ is 10 or more. In a preferred aspect of the invention at least one of the groups $R_1$, $R_2$, $R_3$ and $R_4$ contains from 8 to 18 carbon atoms. For example, 1, 2, 3 or 4 of $R_1$, $R_2$, $R_3$ and $R_4$ can contain from 8 to 18 carbon atoms or 10 to 16 carbon atoms.

Suitable substituents for the groups $R_1$, $R_2$, $R_3$ and $R_4$ may be selected from the group consisting of alkyl, substituted alkyl, alkenyl, substituted alkenyl, heterocyclyl, substituted heterocyclyl, cycloalkyl, substituted cycloalkyl, aryl, substituted aryl, alkylaryl, substituted alkylaryl, arylalkyl, substituted arylalkyl, F, Cl, Br, I, —OR', —NR'R", —$CF_3$, —CN, —$NO_2$, —$C_2$R', —SR', —$N_3$, —C(=O)NR'R", —NR'C(=O) R", —C(=O)R', —C(=O)OR', —OC(=O)R', —O(CR'R")$_r$C(=O)R', —O(CR'R")$_r$NR"C(=O)R', —O(CR'R")$_r$NR"$SO_2$R', —OC(=O)NR'R", —NR'C(=O)OR", —$SO_2$R', —$SO_2$NR'R", and —NR'$SO_2$R", where R' and R" are individually hydrogen, $C_1$-$C_8$ alkyl, cycloalkyl, heterocyclyl, aryl, or arylalkyl, and r is an integer from 1 to 6, or R' and R" together form a cyclic functionality, wherein the term "substituted" as applied to alkyl, alkenyl, heterocyclyl, cycloalkyl, aryl, alkylaryl and arylalkyl refers to the substituents described above, starting with F and ending with —NR'$SO_2$R".

When one or more of $R_1$, $R_2$, $R_3$ and $R_4$ is interrupted, suitable interrupting groups include but are not limited to heteroatoms such as oxygen, nitrogen, sulphur, and phosphorus-containing moieties (e.g. phosphinate). A preferred interrupting group is oxygen.

Suitable anions for the quats include but are not limited to halide anions such as the chloride, fluoride, bromide or iodide and the non halide sulphonate.

Preferred quats are those having the formula:

$$(CH_3)_n(A)_mN^+X^-$$

wherein A may be as defined above in relation to $R_1$, $R_2$, $R_3$ and $R_4$. $X^-$ is selected from chloride, fluoride, bromide or iodide and sulphonate (preferably chloride or bromide), n is from 1 to 3 (preferably 2 or 3) and m is from 1 to 3 (preferably 1 or 2) provided that the sum of n and m is 4. Preferably, A is a $C_{6-20}$ (e.g. $C_{8-18}$, i.e. having 8, 9, 10, 11, 12, 13, 14, 15, 16, 17 or 18 carbon atoms or $C_{8-12}$) substituted or unsubstituted and/or straight chain or branched and/or interrupted or uninterrupted alkyl, aryl, alkylaryl, arylalkyl or cycloalkyl group (wherein suitable substituents are as defined above in relation to $R_1$, $R_2$, $R_3$ and $R_4$). Each group A may be the same or different.

A preferred group of the compounds of formula $(CH_3)_n(A)_m N^+X^-$ are those wherein n=3 and m=1. In such compounds A may be as defined above and is preferably a $C_{6-20}$ substituted or unsubstituted and/or straight chain or branched and/or interrupted or uninterrupted alkyl, aryl, or alkylaryl group. Examples of this type of quaternary ammonium compound include Cetrimide (which is predominately trimethyltetradecylammonium bromide), dodecyltrimethylammonium bromide, trimethyltetradecylammonium bromide, hexadecyltrimethylammonium bromide.

Another preferred group of the compounds of formula $(CH_3)_n(A)_mN^+X^-$ are those wherein n=2 and m=2. In such compounds A may be as defined above in relation to $R_1$, $R_2$, $R_3$ and $R_4$. Preferably A is a $C_{6-20}$ substituted or unsubstituted and/or straight chain or branched and/or interrupted or uninterrupted alkyl, aryl, or alkylaryl group. For example, A may represent a straight chain, unsubstituted and uninterrupted $C_{8-12}$ alkyl group or a benzyl group. In these compounds, the groups A may be the same or different. Examples of this type of compound include didecyl dimethyl ammonium chloride and dioctyl dimethyl ammonium chloride.

Examples of the preferred quaternary ammonium compounds described above include the group of compounds which are generally called benzalkonium halides and aryl ring substituted derivatives thereof. Examples of compounds of this type include benzalkonium chloride, which has the structural formula:

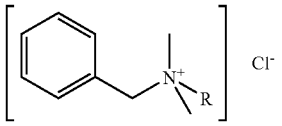

wherein R may be as defined above in relation to $R_1$, $R_2$, $R_3$ and $R_4$. Preferably, R is a $C_{8-18}$ alkyl group or the benzalkonium chloride is provided and/or used as a mixture of $C_{8-18}$ alkyl groups, particularly a mixture of straight chain, unsubtituted and uninterrupted alkyl groups n-$C_8H_{17}$ to n-$C_{18}H_{37}$, mainly n-$C_{12}H_{25}$ (dodecyl), n-$C_{14}H_{29}$ (tetradecyl), and n-$C_{16}H_{33}$ (hexadecyl).

Other preferred quaternary ammonium compounds include those in which the benezene ring is substituted, for example alkyldimethyl ethylbenzyl ammonium chloride. As an example, a mixture containing, for example, equal molar amounts of alkyl dimethyl benzyl ammonium chloride and alkyldimethyl ethylbenzyl ammonium chloride may be used.

Mixtures of, for example, one or more alkyl dimethyl benzyl ammonium chlorides and one or more compounds of formula $(CH_3)_2(A)_2N^+X^-$, such as didecyl dimethyl ammonium chloride may be used.

Typically, mixtures of quaternary ammonium compounds are used. In these mixtures, the quaternary ammonium compounds may be mixed with any suitable inert ingredients. Commercially available benzalkonium chloride often contains a mixture of compounds with different alkyl chain lengths. Examples of commercially available benzalkonium chlorides are shown in the following Table.

| CAS Number | Chemical Name |
|---|---|
| 61789-71-7 | Alkyl (61% C12, 23% C14, 11% C16, 2.5% C8 & C10, 2.5% C18) dimethyl benzyl ammonium chloride |
| | Alkyl (47% C12, 18% C14, 10% C18, 10% C16, 15% C8-C10) dimethylbenzyl ammonium chloride |
| | Alkyl (50% C12, 30% C14, 17% C16, 3% C18) dimethylbenzyl ammonium chloride |
| | Alkyl (50% C14, 40% C12, 10% C16) dimethylbenzyl ammonium chloride |
| 137951-75-8, 68989-01-5 | Alkyl (50% C14, 40% C12, 10% C16) dimethylbenzyl ammonium saccharinate |
| | Alkyl (58% C14, 28% C16, 14% C12) dimethylbenzyl ammonium chloride |
| 68424-85-1 | Alkyl (60% C14, 25% C12, 15% C16) dimethylbenzyl ammonium chloride |
| | Alkyl (60% C14, 30% C16, 5% C12, 5% C18) dimethylbenzyl ammonium chloride |
| 68989-00-4 | Alkyl (61% C12, 23% C14, 11% C16, 3% C10, 2% C8) dimethylbenzyl ammonium chloride |

-continued

| CAS Number | Chemical Name |
|---|---|
| | Alkyl (61% C12, 23% C14, 11% C16, 5% C18) dimethyl benzyl ammonium chloride |
| | Alkyl (61% C12, 23% C14, 11% C16, 5% C8, C10, C18) dimethylbenzyl ammonium chloride |
| | Alkyl (65% C12, 25% C14, 10% C16) dimethylbenzyl ammonium chloride |
| | Alkyl (67% C12, 25% C14, 7% C16, 1% C18) dimethylbenzyl ammonium chloride |
| | Alkyl (67% C12, 25% C14, 7% C16, 1% C8, C10, C18) dimethylbenzyl ammonium chloride |
| | Alkyl (90% C14, 5% C12, 5% C16) dimethylbenzyl ammonium chloride |
| | Alkyl (93% C14, 4% C12, 3% C16) dimethylbenzyl ammonium chloride |
| 68424-85-1 | Alkyl (95% C14, 3% C12, 2% C16) dimethyl benzyl ammonium chloride |
| | Alkyl (95% C14, 3% C12, 2% C16) dimethyl benzyl ammonium chloride dihydrate |
| | Alkyl (95% C14, 3% C12, 2% C16) dimethyl benzyl ammonium chloride monohydrate |
| | Alkyl (C14, C12, C16) dimethyl benzyl ammonium chloride |
| | Alkyl dimethyl cumenyl ammonium chloride |
| | Alkyl dimethyl isopropyl benzyl ammonium chloride |
| | Alkyl(68% C12, 32% C14)dimethyl dimethylbenzyl ammonium chloride |
| 71011-24-0 | Alkyl* dimethyl benzyl ammonium bentonite *(as in fatty acids of tallow) |
| 122-18-9 | Alkyl* dimethyl benzyl ammonium chloride *(100% C16) |
| 122-19-0 | Alkyl* dimethyl benzyl ammonium chloride *(100% C18) |
| 68424-85-1 | Alkyl* dimethyl benzyl ammonium chloride *(40% C12, 40% C14, 20% C16) |
| 68391-01-5 | Alkyl* dimethyl benzyl ammonium chloride *(41% C14, 28% C12, 19% C18, 12% C16) |
| | Alkyl* dimethyl benzyl ammonium chloride *(47% C12, 18% C14, 15% (C5-C15), 10% C18, 10% C16) |
| 8045-22-5, 8001-54-5 | Alkyl* dimethyl benzyl ammonium chloride *(50% C12, 30% C14, 17% C16, 3% C18) |
| 68391-01-5 | Alkyl* dimethyl benzyl ammonium chloride *(55% C16, 20% C14, 20% C12, 5% C18) |
| 68391-01-5 | Alkyl* dimethyl benzyl ammonium chloride *(55% C16, 27% C12, 16% C14, 2% C18) |
| | Alkyl* dimethyl benzyl ammonium chloride *(58% C14, 28% C16, 14% C12) |
| | Alkyl* dimethyl benzyl ammonium chloride *(60% C14, 25% C12, 15% C16) |
| 68424-85-1 | Alkyl* dimethyl benzyl ammonium chloride *(60% C14, 30% C16, 10% C12) |
| 53516-76-0 | Alkyl* dimethyl benzyl ammonium chloride *(60% C14, 30% C16, 5% C18, 5% C12) |
| 68391-01-5 | Alkyl* dimethyl benzyl ammonium chloride *(61% C12, 23% C14, 11% C16, 5% C18) |
| 68989-00-4 | Alkyl* dimethyl benzyl ammonium chloride *(61% C12, 23% C14, 11% C16, 3% C10, 2% C18) |
| | Alkyl* dimethyl benzyl ammonium chloride *(65% C12, 23% C14, 12% C16) |
| 68424-85-1 | Alkyl* dimethyl benzyl ammonium chloride *(65% C12, 25% C14, 10% C16) |
| 68391-01-5 | Alkyl* dimethyl benzyl ammonium chloride *(67% C12, 25% C14, 7% C16, 1% C18) |
| | Alkyl* dimethyl benzyl ammonium chloride *(67% C12, 25% C14, 7% C16, 1% C8, C10, and C18) |
| | Alkyl* dimethyl benzyl ammonium chloride *(67% C12, 27% C14, 6% C16) |
| | Alkyl* dimethyl benzyl ammonium chloride *(68% C12, 25% C14, 7% C16) |
| | Alkyl* dimethyl benzyl ammonium chloride *(90% C14, 5% C12, 5% C16) |
| 68424-85-1 | Alkyl* dimethyl benzyl ammonium chloride *(93% C14, 4% C12, 3% C16) |
| 68607-20-5 | Alkyl* dimethyl benzyl ammonium chloride *(95% C16, 5% C18) |
| | Alkyl* dimethyl benzyl ammonium chloride *(as in fatty acids of coconut oil) |
| | Alkyl* dimethyl benzyl ammonium chloride *(C8-18) |
| | Alkyl* dimethyl benzyl ammonium dichloroisocyanurate *(60% C14, 30% C16, 6% C12, 4% C18) |
| | Alkyl* dimethyl benzyl ammonium ion alkyl** amine *(C12, C14, C16) **(C10, C12, C14, C16) |

-continued

| CAS Number | Chemical Name |
|---|---|
| | Alkyl* dimethyl isopropylbenzyl ammonium chloride *(60% C14, 30% C16, 5% C12, 5% C18) |
| | Alkyl* dodecylbenzyl dimethyl ammonium chloride *(67% C18, 33% C16) |
| | Alkyldimethylbenzyl ammonium chloride |
| 55963-06-9 | BTC 2125-m |
| 73049-75-9 | Dialkyl* methyl benzyl ammonium chloride *(60% C14, 30% C16, 5% C18, 5% C12) |
| | Dimethyl benzyl hydrogenated tallow ammonium cation |
| 7281-04-1 | Dodecyl dimethyl benzyl ammonium bromide |
| 139-07-1 | Dodecyl dimethyl benzyl ammonium chloride |
| 87175-02-8 | Dodecylbenzyl alkyl (70% C12, 30% C14) dimethyl ammonium chloride |
| | N-Alkyl* dimethyl benzyl ammonium chloride *(57% C12, 18% C14, 8% C16, 6% C10-C18, 5% C8) |
| 139-08-2 | Tetradecyl dimethyl benzyl ammonium chloride |
| | Tetradecyl dimethyl benzyl ammonium chloride dihydrate |

It will be appreciated that a single CAS number often refers to more than one blend or mixture. A CAS classification for commercial preparation typically covers blends comprising specified compounds in amounts within defined ranges. The compositions have the CAS numbers quoted above are only examples of compositions having a given CAS number that may be used in the present invention.

Suitable quaternary ammonium compounds in which $R^1$, $R^2$, $R^3$, $R^4$ are interrupted by a heteroatom include domiphen bromide ((Dodecyldimethyl-2-phenoxyethyl)ammonium bromide) and benzethonium chloride (benzyldimethyl[2-[2-[4-(1,1,3,3-tetramethylbutyl)phenoxy]ethoxy]ethyl]ammonium chloride).

Other quaternary ammonium compounds suitable for use in the invention include, but are not limited to, alkylpyridinium compounds, such as cetylpyridinium chloride, and bridged cyclic amino compounds such as the hexaminium compounds.

Other examples of quats which may be used in the present invention are listed below.

Cetalkonium Chloride
Cetylpyridinium Chloride
Glycidyl Trimethyl Ammonium Chloride
Stearalkonium Chloride
Zephiran chloride (R);
Hyamine 3500;
Diisobutylphenoxyethoxyethyldimethylbenzylammonium chloride;
Hyamine 1622(R)
Cetalkonium Chloride:
Cetyldimethylbenzylammonium chloride;
Triton K 12;
Cetyltrimethylammonium bromide
Retarder LA
1-Hexadecylpyridinium chloride
Glycidyltrimethylammonium chloride
Benzethonium Chloride CAS 121-54-0
Cetalkonium Chloride CAS 122-18-9
Cetrimide CAS 8044-71-1
Cetylpyridinium Chloride (anhydrous) CAS 123-03-5
Stearalkonium Chloride CAS 122-19-0
Cetrimonium Bromide CAS 57-09-0

Particularly preferred quaternary ammonium compounds include benzyldimethyl-n-tetradecyl-ammonium chloride, benzyldimethyl-n-dodecyl-ammonium chloride, n-dodecyl-n-tetradecyldimethyl-ammonium chloride and benzyl-$C_{12}$-$C_{16}$-alkyl-dimethyl-ammonium chloride, benzyl-cocoalkyl-dimethyl-ammonium chloride, di-n-decyldimethylammonium chloride.

An example of a suitable mixture is Maquat® A from Mason Quats (a composition comprising octyl decyldimethyl ammonium chloride, didecyl dimethyl ammonium chloride, dioctyl dimethyl ammonium chloride, and alkyl ($C_{14}$, 50%; $C_{12}$, 40%, $C_{16}$, 10%) dimethyl benzyl ammonium chloride as active ingredients (in amounts of for example 3.0%, 1.5%, 1.5% and 4.0% respectively, with 90.0% inert ingredients).

Another suitable mixture is Maquat® 615 5RTU which is a mixture of octyldecyl dimethyl ammonium chloride, didecyl dimethyl ammonium chloride, dioctyl dimethyl ammonium chloride, and alkyl ($C_{14}$, 50%, $C_{12}$, 40%, $C_{16}$, 10%) dimethyl benzyl chloride (in amounts of for example 0.01050%, 0.00525%, 0.00525% and 0.01400% respectively, with 99.96500% inert ingredients).

Another suitable mixture is octyl decyl dimethyl ammonium chloride, dioctyl dimethyl ammonium chloride, didecyl dimethyl ammonium chloride, and alkyl ($C_{14}$, 50%; $C_{12}$, 40%; $C_{16}$, 10%) dimethyl benzyl ammonium chloride (0.0399%, 0.01995%, 0.01995%, 0.05320% respectively with 99.867% inert ingredients).

Examples of other commercially available anti-microbial agents with surfactant properties include BAC 50 (from Thor biocides), and Nobac (Benzalkonium chloride, from Mason Quats).

The anti-microbial agents with surfactant properties that are used in the present invention are not limited to quaternary ammonium compounds. Any suitable anti-microbial agent with surfactant properties may be used.

Other suitable anti-microbial agents with surfactant properties include anionic and cationic surfactant materials as well as amphoteric materials. Examples include quaternary bisammonium surfactants, alkyl betaines, alkyl amine oxides, arginine-based cationic surfactants, anionic amino acid based surfactants and mixtures thereof, for example a mixture of alkyl betaine(s) and alkyl amine oxides An example of a Betaine which is suitable for use in the present invention is Macat® Ultra (available from Mason Chemical Company). Macat® Ultra CG comprises 30% coco ($C_{12}$) amidopropyl dimethyl glycine (betaine) in water.

An example of an alkyl amine oxide which is suitable for use in the present invention is Macat® Ultra CDO (available from Mason Chemical Company), a 30% solution of coco ($C_{12}$) amidopropyl dimethyl amine oxide in water.

One or more of any of the anti-microbial agents with surfactant properties described above may be used as component (i) in the compositions of the invention.

The amount of component (i) will vary depending on a number of factors, such as the intended use of the composition and the particular compound(s) used as component (i).

Siloxanes suitable for use in the compositions of the present invention are those having the formulae $(H_3C)[SiO(CH_3)_2]_nSi(CH_3)_3$, and $(H_3C)[SiO(CH_3)H]_nSi(CH_3)_3$ where n is an integar, of from 1 to 24, more preferably from 1 to 12 and most preferably from 1 to 8, for example n may be 1, 2, 3, 4, 5, 6, 7, 8, 9, 10, 11 or 12, especially 1, 2, 3 or 4. These materials are often referred to as (poly)dimethylsiloxanes (CAS #9016-00-6) and (poly)methylhydrosiloxanes respectively. These materials are linear siloxanes and cyclic siloxanes are typically not used in this invention.

These materials are typically liquid at ambient temperature and pressure (e.g. about 20° C. at atmospheric pressure).

The siloxanes suitable for use in the compositions of the present invention typically have a molecular weight of from about 100 to about 2000 g/mol, preferably from about 148 to about 1864 (such as from about 162 to about 1864 or about 148 to about 1528), more preferably from about 148 to about 1000 or about 976 (e.g. from about 162 to about 976 or about 148 to about 808), such as from about 148 to about 680 (e.g. from about 162 to about 680 or about 148 to about 568), particularly from about 148 to about 384 (e.g. from about 162 to abiyt 384 or about 148 to about 328).

Examples of preferred (poly)dimethylsiloxanes are hexamethyldisiloxane (CAS #107-46-0), octamethyltrisiloxane (CAS #107-51-7), decamethyltetrasiloxane (CAS #141-62-8), dodecamethylpentasiloxane (CAS #141-63-9). These (poly)dimethylsiloxanes correspond to the compounds of formula $(H_3C)[SiO(CH_3)_2]_nSi(CH_3)_3$, wherein n=1, 2, 3 and 4 respectively.

These materials are generally also strongly hydrophobic. By this we include the meaning that it is repelled from a mass of water and by itself is substantially insoluble in water. By the term "substantially insoluble in water", we mean that the material typically has a solubility of less than 2 g/100 g water at 20° C. and atmospheric pressure, such as less than 1 g/100 g water, preferably, less than 0.5 g/100 g water, for example less than 0.1 g/100 g water, e.g. less than 0.01 g/100 g water.

The siloxanes which may be used in the compositions of the invention typically have a viscosity of from about 0.1 to about 100 centistokes at atmospheric pressure and at about 20° C., preferably from about 0.2 to about 20. Preferred siloxanes have a viscosity of from about 0.5 to about 5 centistokes, e.g. 0.65, 1, 1.5, 2, 3, 4, 5, 6, 7, 8, 9, or 10 centistokes or from 3 to 5 centistokes.

The siloxanes used in the present invention, due to their relatively low molecular weight, are relatively volatile. For example, they typically have a boiling point of less than about 120° C. at atmospheric pressure, for example from about 100 to 120° C. Hexamethydisiloxane, for example, has a boiling point of about 101° C. at atmospheric pressure.

The siloxanes described above may be used alone or in combination. Many commercially available siloxanes are provided as mixtures and these can be used in the present invention without the need to separate the components of the mixture. Details of commercially available siloxanes which are suitable for use in the compositions of the invention are set out, for example, at http://www.clearcoproducts.com/standard pure silicones.html.

For example a mixture of two, three, four, five or more siloxanes may be used. If a combination of siloxanes is used the materials may be used in equal or differing amounts. For example each siloxane may be used in equimolar amounts or the amount by weight of each siloxane may be the same. Other suitable ratios (in terms of molar amounts or by weight of the total amount of siloxanes) when a mixture of two siloxanes are used range from 0.1:99.9 to 99.9:0.1, preferably from 1:99 to 99:1, more preferably from 95:5 to 5:95, for example from 10:90 to 90:10 or from 25:75 to 75:25. For example, if a combination of hexamethyldisiloxane and octamethyltrisiloxane is used any ratio described above may be used. One particular combination comprises hexamethyldisiloxane: octamethyltrisiloxane in a ratio of 95:5.

It is a preferred aspect of the invention to use a mixture of two or more siloxanes. The use of the combination of hexamethyldisiloxane and octamethyltrisiloxane is particularly preferred.

If the composition comprises three silicone materials, the total siloxanes typically comprises from 0.1 to 99.8% by weight of the total amount of siloxanes of each of the first, second, and third silicone material, preferably from 1 to 98% weight of the total amount of siloxanes of each of the first, second, and third siloxanes, more preferably from 5 to 90% weight of the total amount of siloxanes of each of the first, second, and third siloxanes, for example from 10 to 80% weight of the total amount of silicone material of each of the first, second, and third siloxanes, such as from 25 to 50% weight of the total amount of siloxanes of each of the first, second, and third siloxanes.

If the composition comprises four siloxanes, the total siloxanes typically comprises from 0.1 to 99.7% by weight of the total amount of siloxanes of each of the first, second, third and fourth siloxanes, preferably from 1 to 97% by weight of the total amount of siloxanes of each of the first, second, third and fourth siloxanes, more preferably from 5 to 85% by weight of the total amount of siloxanes of each of the first, second, third and fourth siloxanes, for example from 10 to 70% by weight of the total amount of siloxanes of each of the first, second, third and fourth siloxanes, such as from 20 to 40% by weight of the total amount of siloxanes of each of the first, second, third and fourth siloxanes.

If the composition comprises five siloxanes, the total siloxanes typically comprises from 0.1 to 99.6% by weight of the total amount of siloxanes of each of the first, second, third, fourth and fifth siloxanes, preferably from 1 to 96% by weight of the total amount of siloxanes of each of the first, second, third, fourth and fifth siloxanes, more preferably from 5 to 80% by weight of the total amount of siloxanes of each of the first, second, third, fourth and fifth siloxanes, for example from 10 to 60% by weight of the total amount of siloxanes of each of the first, second, third, fourth and fifth siloxanes, such as 15 to 40% by weight of the total amount of siloxanes of each of the first, second, third, fourth and fifth siloxanes.

The compositions of the invention comprise a polar solvent, component (iii). Suitable polar solvents include, but are not limited to, water, alcohols, esters, hydroxy and glycol esters, polyols and ketones, and mixtures thereof.

Suitable alcohols include, but are not limited to, straight or branched chain $C_1$ to $C_5$ alcohols, such as methanol, ethanol, n-propanol, iso-propanol, mixtures of propanol isomers, n-butanol, sec-butanol, tert-butanol, iso-butanol, mixtures of butanol isomers 2-methyl-1-butanol, n-pentanol, mixtures of pentanol isomers and amyl alcohol (mixture of isomers), and mixtures thereof.

Suitable esters include, but are not limited to, methyl acetate, ethyl acetate, n-propyl acetate, iso-propyl acetate, n-butyl acetate, iso-butyl acetate, sec-butyl acetate, amyl acetate (mixture of isomers), methylamyl acetate, 2-ethylhexyl acetate and iso-butyl isobutyrate, and mixtures thereof.

Suitable hydroxy and glycol esters include, but are not limited to, methyl glycol acetate, ethyl glycol acetate, butyl glycol acetate, ethyl diglycol acetate, butyl diglycol acetate, ethyl lactate, n-butyl lactate, 3-methoxy-n-butyl acetate, ethylene glycol diacetate, polysolvan O, 2-methylpropanoic acid-2,2,4-trimethyl-3-hydroxypentyl ester, methyl glycol, ethyl glycol, iso-propyl glycol, 3-methoxybutanol, butyl glycol, iso-butyl glycol, methyl diglycol, ethyl diglycol, butyl diglycol, iso-butyl diglycol, diethylene glycol, dipropylene glycol, ethylene glycol monohexyl ether and diethylene glycol monohexyl ether, and mixtures thereof.

Suitable polyols include, but are not limited to, ethylene glycol, propylene glycol, 1,3-butylene glycol, 1,4-butylene glycol, hexylene glycol, diethylene glycol, triethylene glycol and dipropylene glycol, and mixtures thereof.

Suitable ketones include, but are not limited to iso-butyl heptyl ketone, cyclohexanone, methyl cyclohexanone, methyl iso-butenyl ketone, pent-oxone, acetyl acetone, diacetone alcohol, iso-phorone, methyl butyl ketone, ethyl propyl ketone, methyl iso-butyl ketone, methyl amyl ketone, methyl iso-amyl ketone, ethyl butyl ketone, ethyl amyl ketone, methyl hexyl ketone, diisopropyl ketone, diisobutyl ketone, acetone, methyl ethyl ketone, methyl propyl ketone and diethyl ketone, and mixtures thereof.

Preferred polar solvents for use in the compositions of the invention include, but are not limited to, water, ethanol, n-propanol, isopropanol, diethylene glycol and dipropylene glycol and mixtures thereof.

It is a particularly preferred feature of the invention that the composition comprises water or a mixture of water and one or more alcohols selected from the alcohols described above. In such mixtures, water is preferably the major component.

The compositions of the invention may contain components in addition to components (i), (ii) and (iii) set out above. For example, one or more additional antimicrobial agents (iv) may be included. Any suitable additional antimicrobial agent(s) may be used, such as those described in the EPA (United States Environmental Protection Agency) Listing and Annex I of the EC Biocides Directive.

Suitable additional anti-microbial agents (iv) include amphoteric compounds, iodophores, phenolic compounds, hypochlorites and nitrogen based heterocyclic compounds.

Preferably, the additional antimicrobial agent(s) are water soluble at room temperature and pressure.

Without being bound by theory, it is believed that the inclusion of one or more water soluble additional antimicrobial agent(s) (iv) complements the biocidal activity of the colloidal dispersion formed between components (i) and (ii). It is believed that in some circumstances the additional antimicrobial agent(s) increase the longlasting efficacy of the compositions of the invention.

Preferred additional antimicrobial agents (iv) include polymeric biguanidines (e.g. polyhexamethylene biguanidine (PHMB)), isothiazalones, ortho phenyl phenol (OPP), and nitro bromopropanes (e.g. bronopol (INN), 2-bromo-2-nitropropane-1,3-diol) and polymerised quaternary ammonium compounds.

A particularly preferred additional antimicrobial agent (iv) is polyhexamethylene biguanidine (PHMB). PHMB is commercially available from Arch Biocides as Vantocil.

It is believed that in the compositions of the invention the majority (greater than 50%) of the component (i) and the component (ii) are present in colloids containing both of these components. If additional anti-microbial agent is used, this material may also be contained in the colloids and/or may be dissolved in the polar solvent.

A colloid or colloidal dispersion is a heterogeneous mixture that visually appears to be a homogeneous solution. Some colloids are translucent because of the Tyndall effect, which is the scattering of light by particles in the colloid. Other colloids may be opaque or have a slight color. The colloids in the compositions of the present invention are typically not opaque.

In a colloid, the dispersed phase is made of tiny particles or droplets that are distributed evenly throughout the continuous phase. The size of the dispersed phase particles or droplets is typically between one nanometer and one micrometer. Heterogeneous mixtures with a dispersed phase in this size range may be called colloidal sols, colloidal emulsions, colloidal foams, colloidal suspensions or colloidal dispersions.

The dispersed phase particles or droplets are largely affected by the surface chemistry present in the colloid. For example, colloidal particles often carry an electrical charge and therefore attract or repel each other. The charge of both the continuous and the dispersed phase, as well as the mobility of the phases are factors affecting this interaction.

The skilled person in the field of colloids would readily be able to select suitable materials for use as components (i) and (ii) based on the information provided in this specification on such materials, the anti-microbial agent with surfactant properties and polar solvent with which such a material forms the colloidal dispersion, and their knowledge of colloids (see, for example, http://en.wikipedia.org/wiki/Colloid).

As will be appreciated, the percentage by weight of each of components (i), (ii) and optionally, (iv) in the compositions of the invention will depend to a large extent on the form in which a composition is provided and the intended use of a composition. It is envisaged that the compositions will be made in a concentrated form and then diluted to a suitable concentration for the intended use. More particularly, it is envisaged that commercially available solutions will include concentrated solutions which can be diluted by the user before use and ready diluted solutions that are ready to use.

The important thing for compositions of the invention to provide the required anti-microbial effect is not typically the concentration of the components in the final solution, rather it is the ratio the number of molecules of the components. This ratio will remain the same whether the composition is in a concentrated form or whether it is in a dilute (ready-to-use) form.

Typically, the ratio the number of molecules of the component (i) to the component (ii) ranges from about 100:1 to 5:1, preferably from about 90:1 to about 8:1, more preferably from about 80:1 to about 15:1, still more preferably from about 70:1 to about 25:1 or about 20:1, most preferably from about 40:1 to about 60:1, for example about 50:1.

The ratio of molecules of the component (i) to molecules of the optional additional anti-microbial agent, if used, is typically from about 1:2 or about 1:1 to about 50:1, preferably about 2:1 to about 30:1, more preferably from about 4:1 to about 20:1, most preferably from about 8:1 to about 15:1, for example about 10:1.

In a typical composition of the invention the total number of molecules of (i) and (iv) to every molecule of (ii) is from about 5 to about 80, for example from about 10 to about 60, e.g. around 50.

It has been found that in use compositions of the invention which comprise at least components (i) and (ii) in the ratios set out above have an advantageous anti-microbial effect. For example, such compositions can have an enhanced kill rate when they are applied to a surface (so called "wet kill") and/or they can also have a residual effect in that they prevent the formation of new microbial colonies at the surface (so called "dry kill") and/or they are effective at significantly lower concentration of ant-microbial agent than previously known compositions.

Typically, component (i) is present in the compositions of the invention in an amount of from about 0.01 to about 50% by weight of the compositions, such as from about 0.02 to about 40%, for example from about 0.05 to about 30%, preferably from about 0.1 to about 20% (e.g. from 0.2 to 15% or 0.5 to 10%).

Typically, the component (ii) is present in the compositions of the invention in an amount of from about 0.001 to about 10% by weight of the compositions, such as from about 0.002 to about 5%, for example from about 0.003 to about 2%, preferably from about 0.005 to about 1% (e.g. from 0.008 to 0.8% or 0.1 to 0.5%). The amount of component (ii) will vary depending on a number of factors, such as the intended use of the composition, the colloid-forming material used and its properties (e.g. viscosity and volatility).

Typically, the polar solvent component (iii) is present in the compositions of the invention in an amount of from about 10 to about 99.999% by weight of the compositions, such as from about 50 to about 99.999%, for example from about 80 to about 99.99%, preferably from about 90 to about 99.9%, more preferably from about 95 to about 99.8% (e.g. from 97 to 99.7% or 97.5 to 99.6%).

Typically, the additional anti-microbial agent(s), such as PHMB, is present in the compositions of the invention in an amount of from about 0.001 to about 10% by weight of the compositions, such as from about 0.005 to about 5%, for example from about 0.01 to about 2%, preferably from about 0.05 to about 1% (e.g. from 0.1 to 0.5%).

It will be appreciated that the actual concentration of components (i), (ii) and (iv) (if present) in a composition of the invention will depend on the intended use of that composition. For disinfecting uses, such as cleaning of hospital wards and equipment to help prevent the spread of disease such as MRSA, higher concentrations are required than for certain sanitising applications.

The present invention provides an anti-microbial composition comprising (I) colloids of components (i), (ii) and optionally (iv) as defined above and (II) a polar solvent (iii).

It is believed that in the compositions of the invention the majority (greater than 50% preferably greater than 75%, more preferably greater than 90% and most preferably substantially all (at least 97%) or 100%) of the component (i) and the component (ii) are present in colloids containing both of these components. If an additional anti-microbial agent is used, this material may also be contained in the colloids and/or may be dissolved in the polar solvent.

A colloid or colloidal dispersion is a heterogeneous mixture that visually appears to be a homogeneous solution. Some colloids are translucent because of the Tyndall effect, which is the scattering of light by particles in the colloid. Other colloids may be opaque or have a slight color. The colloids in the compositions of the present invention are typically not opaque.

In a colloid, the dispersed phase is made of tiny particles or droplets that are distributed evenly throughout the continuous phase. The size of the dispersed phase particles or droplets is typically between one nanometer and one micrometer. Heterogeneous mixtures with a dispersed phase in this size range may be called colloidal sols, colloidal emulsions, colloidal foams, colloidal suspensions or colloidal dispersions.

We use the term colloid herein to encompass various colloidal structures including but not limited to vesicles and micelles, which may for example by spherical or cylindrical.

The dispersed phase particles or droplets are largely affected by the surface chemistry present in the colloid. For example, colloidal particles often carry an electrical charge and therefore attract or repel each other. The charge of both the continuous and the dispersed phase, as well as the mobility of the phases are factors affecting this interaction.

The skilled person in the field of colloids would readily be able to select suitable materials for use as components (i) and (ii) based on the information provided in this specification on such materials, the anti-microbial agent with surfactant properties and polar solvent with which such a material forms the colloidal dispersion, and their knowledge of colloids (see, for example, http://en.wikipedia.org/wiki/Colloid).

Without wishing to be bound by theory, the inventors have found that there are very significant advantages associated with the compositions of the invention. It is thought that the colloidal nature of the compositions of the invention is responsible for one or more of these advantages.

In use the compositions of the invention act to substantially reduce or control the formation of microbial colonies on or at the surface to which they are applied. This means that not only do the compositions of the invention kill any microorganisms that are present on a surface when they are applied to that surface (so called "wet kill"), they also have a residual effect in that they prevent the formation of new microbial colonies at the surface (so called "dry kill"). It is believed that the siloxane and the antimicrobial agent(s) (for example in the form of colloids) present in the compositions of the invention remain on the surface after the polar solvent has evaporated and that the presence of these components on the surface prevents bio-film formation/the growth of colonies of microorganisms. The residual effect can often be seen even after a treated surface has been washed or rinsed with water and sometimes even after numerous washings or rinsings.

Anti-microbial compositions are considered to have residual efficacy if, in the residual efficacy test described herein, they give a reduction in the number of micro-organisms which is at least log 3.0. Preferably an anti-microbial composition having a residual effect and tested in this manner will give a log reduction of at least about 3.5, more preferably at least about 5.0 and most preferably about 7.0 or more, up to total kill or substantially total kill (zero survivors) under the test conditions described above.

In a particular aspect, the present invention provides anti-microbial compositions which have residual efficacy. By this we mean that these compositions when tested in accordance with the residual efficacy test described herein have an anti-microbial efficacy within the parameter set out in the paragraph above.

It has been found that the unique composition of the compositions of the invention (which may comprise colloids of the siloxane and the antimicrobial agent(s)) results in increased anti-microbial efficiency (either in terms of higher initial rates of kill and/or in terms of residual efficacy) compared to the use of the anti-microbial agents alone. This is particularly surprising because the siloxanes used in the invention do not themselves have any anti-microbial properties. This means that the concentration of anti-microbial agent required in the compositions of the invention to give the desired effect can be lower than that required in many conventional anti-microbial compositions.

The prevention of the formation of a biofilm and the greatly reduced and attenuated colonies of microorganisms provides a substantially reduced risk due to infection or contamination.

The anti-microbial compositions of the invention are typically able to break down biofilms that have already formed.

As the anti-microbial compositions of the invention physically disrupt the adhesion and attachment of a microorganism to a surface, which is a feature that is common to a wide range of microorganisms, including bacteria, fungi and moulds, the compositions are effective against a broad range of microorganisms. Thus, an advantage of the anti-microbial compositions of the invention is that they are able to prevent a broad range of microorganisms from adhering and attaching to the surface, and, therefore, from forming a biofilm. Large numerous colonies are also substantially prevented from forming. Thus, the ability of the colony to grow is substantially reduced or even prevented. The anti-microbial compositions of the invention are, therefore, general in their control of microorganisms.

The anti-microbial compositions of the invention can easily be incorporated into other materials, such as functional materials. When incorporated into such materials, these become anti-microbial in nature and the surface of the formulation will be modified so as to substantially prevent the microorganisms from adhering and attaching thereto.

Another advantage of the anti-microbial compositions is that they need not comprise combinations of materials that are highly toxic to mammals. The anti-microbial agents used in the anti-microbial compositions are typically well known and widely understood and tested anti-microbial agents. The efficacy of the known anti-microbial agents is amplified in the compositions of the invention. Therefore, anti-microbial agents that have a low toxicity can be used in the anti-microbial compositions. In contrast, new anti-microbial agents for known techniques of sanitization use "stronger", more toxic and/or little tested materials.

The anti-microbial compositions of the invention also do not comprise materials that produce highly persistent residues or rinsates or products that contain heavy metals and their salts. Thus, there is a greatly reduced risk of long term hazards associated with the anti-microbial compositions.

The composition of the invention does not interfere with the biochemical reproductive pathways of the microorganisms it controls. The risk of resistance build up and the development of resistant strains is, therefore, low.

As general rule, the antimicrobial efficacy of the compositions of the invention increases with increasing concentration of the antimicrobial agents contained therein. However, the compositions of the invention can be surprisingly effective at low concentration of antimicrobial agents (i.e. high dilution by polar solvents) compared to known antimicrobial compositions of the same antimicrobial concentration. It has been found that the compositions of the invention can be effective when the total concentration of the anti-microbial agents (i) and (iv) is as low as from about 400 or less to about 30 ppm such as from about 300 to about 50 ppm for example about 200 to about 75 ppm, or about 150 to about 100 ppm (for example compositions comprising a total of about 95 ppm of components (i) and (iv) and about 5 ppm of component (ii)). This is very surprising as it is thought that in conventional anti-microbial compositions (such as those comprising quaternary ammonium compounds) the concentration of anti-microbial agent must be at least about 400 ppm. This enhanced activity is believed to be associated with a variation in the nature of the colloidal structures as the concentration of components (i), (ii) and (iv) (if present) is varied.

The present invention provides compositions which comprise the low levels of anti-microbial agent described in the paragraph above and also provides more concentrated compositions, which contain higher levels of anti-microbial agent that can be diluted before or during use to provide the low levels of anti-microbial agent described in the paragraph above.

Compositions comprising this low level of anti-microbial agent are particularly useful for sanitization applications and for long term applications.

Compositions are considered to have anti-microbial efficacy if, in the suspension test with *Escherichia coli* K12 O Rough H48 described herein, they give a reduction in the number of micro-organisms which is at least about log 5.0. This is in accordance with the European standard (1276) for suspension tests. Compositions having anti-microbial efficacy can be considered to be those that when subjected to this test provide a reduction in the number of micro-organisms of at least about log 5.0 to total kill or zero survivors. Preferably an anti-microbial composition provides a reduction in the number of micro-organisms of at least about log 6.0 more preferably about 7.0 or more under the test conditions described above. Most preferably an anti-microbial composition provides substantially zero survivors or substantially total kill under the test conditions described above.

Thus, in a particular aspect, the present invention provides compositions having the low concentrations of anti-microbial agents mentioned above which have an anti-microbial efficacy when subjected to the suspension test with *Escherichia coli* K12 O Rough H48 described herein within the parameter set out in the paragraph above. The present invention also provides compositions which can be diluted to have those low concentrations of anti-microbial agent and which have an anti-microbial efficacy when subjected to the suspension test with *Escherichia coli* K12 O Rough H48 described herein within the parameter set out in the paragraph above when diluted to those concentrations.

Without being bound by theory, it is thought that the components (i) and (ii) which are thought to make up the colloidal dispersions in the compositions of the invention may form different colloidal structures depending on the concentration of those components in solution. These different structures may typically have a preferred range of concentration of components (i) and (ii) at which they are formed, the so-called critical micelle concentration.

The size and morphology of the colloidal structures in the compositions of the invention is thought to vary depending on factors such as the concentration of the ingredients that form colloids. For example, it is thought that when the compositions comprise from about 500,000 ppm to about 5000 ppm of component (i), component (ii) and component (iv) (if present) (the combined amount of these components) the colloids typically have an average (mean) diameter of from about 1 to about 120 nm, for example from about 2 to about 100 nm, for example from about 5 to about 80 nm, for example from about 10 or about 20 nm to about 60 nm.

It is believed that as the concentration of the components (i), (ii) and (iv) (if present) decreases below about 5000 ppm to about 30 ppm or about 50 ppm or about 100 ppm the size of the colloids changes and so does their morphology.

Colloidal particle size measurements may be made using any suitable method, for example by Dynamic Light Scattering (e.g. using a Malvern Zetasizer).

It is believed that at lower combined concentrations of components (i) and (ii), such as from about 0.002 to about 5% by weight of the compositions (e.g. 0.005 to about 1%), the compositions are surprisingly effective as antimicrobials. This may be due to the presence at larger vesicles in the colloidal suspension compared to more concentrated solutions. These vesicles are thought to contain a greater number of anti-microbial molecules. Each vesicle may, therefore, have an enhanced anti-microbial effect.

The use of siloxanes within the definition of component (ii) used above can provide other particular additional advantages which make the compositions of the invention particularly suitable for a number of applications particularly consumer applications. For example, if the colloid is broken (e.g. on a surface due to abrasion) these relatively volatile materials evaporate so that they do not persist on the surface.

The compositions of the invention do not give surfaces to which they are applied a greasy feel. Additionally, compositions containing them have a very good hand feel which makes them particularly suitable for uses such as hand sanitizing.

According to a further aspect of the invention, there is provided a formulation comprising an anti-microbial composition and at least one other functional material or substrate.

Suitable functional materials or substrates include plastics, fibres, coatings, films, laminates, adhesives, sealants, clays, china, ceramics, concrete, sand, paints, varnishes, lacquers, cleaning agents or settable or curable compositions such as fillers, grouts, mastics and putties.

The plastics may be in the form of films, sheets, stabs and molded plastic parts. Suitable plastics materials may be prepared from polyesters such as polyethylene terephthalate, polybutylene terephthalate, polyamides such as Nylon, polyimides, polypropylene, polyethylene, polybutylenes, polymethylpentene, polysiloxane, polyvinyl alcohol, polyvinylacetate, ethylene-vinylacetate, polyvinyl chloride, polyvinylidene chloride, epoxy, phenolic and polycarbonate cellulosics, cellulose acetate, polystyrene, polyurethane, acrylics, polymethyl methacrylate, acrylonitrile, butadiene-styrene copolymer, acrylonitrilestyrene-acrylic copolymers, acetals, polyketones, polyphenylene ether, polyphenylene sulphide, polyphenylene oxide, polysfulfones, liquid crystal polymers and fluoropolymers, amino resins, thermo plastics, elastomers, rubbers such as styrene butadiene rubber and acrylonitrile butadiene rubber, polyacetal (polyoxymethylene), and blends and copolymers thereof.

Formulations comprising an anti-microbial composition of the invention and a plastics material as the functional material may, for example, be used to form products such as automobile parts, shower curtains, mats, protective covers, tape, packaging, gaskets, waste containers, general purpose containers, brush handles, sponges, mops, vacuum cleaner bags, insulators, plastic film, indoor and outdoor furniture, tubing, insulation for wire and cable, plumbing supplies and fixtures, siding for housing, liners, non-woven fabrics, kitchen and bathroom hardware, appliances and equipment, countertops, sinks, floor covering, tiles, dishes, conveyer belts, footwear including boots, sports equipment and tools.

Suitable fibres may be prepared from acetate, polyester such as PET and PTT, polyolefins, polyethylene, polypropylene, polyamides such as Nylon, acrylics, viscose, polyurethane, and Rayon, polyvinyl alcohol, polyvinyl chloride, polyvinylidene chloride, polysaccharide, and copolymers and blends thereof.

Formulations comprising the anti-microbial composition and a fibre as the funcitional material, may for example, be used in applications such as mattress cover pads and filling, pillow covers, sheets, blankets, fibrefill for quilts and pillows, curtains, draperies, carpet and carpet underlay, rugs upholstery, table cloths, napkins, wiping cloths, mops, towels, bags wall covering fabrics, cushion pads, sleeping bags and brush bristles. The fibres are also suitable for use in automotive and truck upholstery, carpeting, rear decks, trunk liners, convertible tops and interior liners. Furthermore, the fibres are suitable for use in umbrellas, outerwear, uniforms, coats, aprons, sportswear, sleepwear, stockings, socks, hosiery caps, and undergarment and inner liners for jackets, shoes, gloves and helmets, trim for outerwear and undergarments as well as brush bristles, artificial leather, filters, book covers, mops, cloth for sails, ropes, tents, and other outdoor equipment, tarps and awnings.

Coatings suitable for use in the formulations include water-borne, solvent-borne, 100% solids and/or radiation cure coatings. The coatings may be liquid or powder coatings.

Suitable coatings, films and laminates include alkyds, amino resins, such as melamine formaldehyde and urea formaldehyde, polyesters, such as unsaturated polyester, PET, PBT, polyamides such as Nylon, polyimides, polypropylene, polyvinylacetate, ethylene-vinylacetate, polyvinyl chloride, polyvinylidene chloride, epoxy, phenolic and polycarbonate cellulosics, cellulse acetate, polystyrene, polyurethane, acrylics, polymethyl methacrylate, acrylonitrile-butadiene-styrene copolymer, acrylonitrile-styreneacrylic copolymers, acetals, polyketones, polyphenylene ether, polyphenylene sulphide, polyphenylene oxide, polysulfones, liquid crystal polymers and fluoropolymers, thermoplastic elastomers, rubbers such as styrene butadiene rubber, acrylonitrile butadiene rubber, polyacetal (polyoxymethylene), and blends and copolymers thereof.

Formulations comprising the anti-microbial composition and coatings as the functional material may, for example, be used on walls, wall boards, floors, concrete, sidings, roofing shingle, industrial equipment, natural and synthetic fibres and fabrics, furniture, automotive and vehicular parts, packaging, paper products (wall coverings, towels, book covers) barrier fabrics, and glazing for cement tile and for vitreous china used in plumbing fixtures such as toilets, sinks, and countertops.

Adhesives and sealants suitable for use in the formulations include hot-melt, aqueous, solvent borne, 100% solids and radiation cure adhesives and sealants.

Suitable adhesives and sealants include alkyds, amino resins such as melamine formaldehyde and urea formaldehyde, polyesters such as unsaturated polyester, PET, PBT, polyamides such as Nylon, polyimide polypropylene, polyethylene, polybutylene, polymethylpentene, polysiloxane, polyvinyl alcohol, polyvinylacetate, ethylene-vinylacetate, polyvinyl chlorides such as plastisol, polyvinylidene chloride, epoxy, phenol and polycarbonate, cellulosics, cellulose acetate, polystyrene, polyurethane, acrylics, polymethylmethacrylate, acrylonitrile-butadienestyrene copolymer, acrylonitrile-styrene-acrylic copolymers, acetals, polyketones, polyphenylene ether, polyphenylene sulphide, polyphenylene oxide, polysulfones, liquid crystal polymers and fluoropolymers, thermoplastic elastomers, rubbers (including styrene butadiene rubber) acrylonitrile butadiene rubber, CR), polyacetal (polyoxymethylene), and blends and copolymers thereof.

Formulations comprising the anti-microbial composition and an adhesive or sealant as the functional material may, for example, be used in the manufacture of wood and plastic composites, adhesives for ceramic tiles, wood, paper, cardboard, rubber and plastic, glazing for windows, grout, sealants for pipes, adhesives, sealants and insulating materials for appliances, bathrooms, showers, kitchens, and construction.

Formulations comprising the anti-microbial composition and clay, china, ceramics, concrete, sand or grout as the functional material may, for example, be used in toilets, sinks, tile, flooring, stucco, plaster, cat littler, drainage and sewerage pipe.

The anti-microbial composition can be combined into a very wide variety of functional compounds for the manufacturing, contracting and construction industries. The nature of the anti-microbial composition may be varied according to the particular functional compounds and the number and nature of microorganisms present in the particular functional compound.

The anti-microbial compositions of the invention and formulations comprising them can typically degrade when submersed in water, to provide a rinsate/leachate of low toxicity and which has a short residence time in the environment.

It is thought that the rinsate has a low toxicity because the anti-microbial agents are associated with the second compound and so the composition does not readily dissociate in the presence of water.

The formulation can be designed so that they are stable and effective in most manufacturing environments. The formulation is typically stable up to temperatures of 200° C.

The property of mobility of the product permits materials that are frequently washed or rinsed to be "recharged" with the anti-microbial composition during a routine act of cleaning or maintenance.

Typically, the anti-microbial composition is incorporated into a simple conventional detergent solution or added to a "final rinse" during cleaning. The anti-microbial composition will be drawn, due to the presence of its hydrophobic elements, into the surface of the product to be "recharge". The sanitization properties of the formulation are, therefore, restored without the need for re-manufacture or difficult treatment processes.

Any wash off or rinsates containing the anti-microbial composition or formulation diluted by such a re-charging solution and water would quickly dissociate into the biodegradable components as previously discussed.

According to a further aspect of the invention, there is provided the use of an anti-microbial composition of the invention to prevent the formation of colonies of microorganisms on a surface at which it is provided.

According to yet a further aspect of the invention, there is provided the use of a formulation to prevent the formation of colonies of microorganisms on a surface at which it is provided.

The invention also provides a process for making the compositions of the invention. The process comprises the steps of (A) mixing component (i) and component (ii); (B) adding the polar solvent to the mixture formed in step (A); and (C) agitating the resulting mixture until a clear solution is formed.

If component (i) is a solid, step (A) can be carried out in sufficient polar solvent to dissolve component (i). Alternatively, some materials which may be used a component (i) are commercially available in solution. In this case, these materials can be used in step (A) in their commercially available form.

Typically, the mixture used in step (A) comprises from about 1 to about 25% by weight of a polar solvent, more preferably from about 2 to about 8% by weight polar solvent. If the amount of solvent used in step (A) is too great, the colloids will not form. The person of ordinary skill in the art could readily determine an appropriate amount of solvent to use. If too much solvent is used the initial cloudy solution will not become clear (the clear solution is thought to be associated with the formation of colloids). The polar solvent typically use in step (A) is water, although other polar solvents may be used alternatively or additionally.

If one or more additional antimicrobial agents (iv) are used, these may be introduced in step (A) or they may be added in step (B). If they are added in step (A) at least some of the additional antimicrobial agent may be included in any colloidal particles. If the additional antimicrobial agent(s) are added in step (B) they are more likely to simply dissolve in the polar solvent (provided of course that they are soluble in that solvent). However, they may also attach to the outer surface of a colloid.

Typically, the process to produce the compositions of the invention is carried out at room temperature with stirring. In step (A) the mixture is initially cloudy because the component (ii) is insoluble in the polar solvent.

Typically step (A) is complete when the solution becomes clear. It is thought that this clear solution contains colloids or micelles of the components (i) and (ii) and the additional anti-microbial agents (iv), if used.

If an antimicrobial agent that is not soluble in the polar solvent is used, it should be added in step (A) so that it may form part of the colloids.

In step (A) the components may be mixed in any manner suitable (for example to maximize the formation of colloidal structures (e.g. micelles and vesicles)). This may be achieved by slow addition of a component (i) to component (ii) or visa versa and then mixing (for example stirring overnight). The rate of addition of the components often needs to be regulated to prevent "shock" which can prevent adequate mixing and/or colloid formation. It would be a routine matter for the person of ordinary skill in the art to determine a suitable rate of addition. The mixing/blending steps can also use techniques ultrasonic mixing/blending.

The present invention provides compositions obtainable by the process set out above.

The compositions of the invention may be prepared in a concentration form (i.e. with little or no polar solvent) and diluted with polar solvent (e.g. water) when used.

Testing Methods

1. Evaluation of Bactericidal Activity Using Suspension Test with *Escherichia coli* K12 O Rough H48

The aim of the test is to evaluate the bactericidal activity of products of the invention against *Escherichia coli* K12 O Rough H48.

| Media and Materials | | |
|---|---|---|
| Luria broth (LB) | 10 g tryptone + 5 g yeast extract + 10 g NaCl/L water | LB is sterilized by autoclaving. |
| Luria broth Aga (LBA) | 15 g agar + 10 g tryptone + 5 g yeast extract + 10 g NaCl/L water | LBA is sterilized by autoclaving. |
| Neutralising solution (NF) | 30 mL Tween 80 + 30 g saponine + 1 g histidine + 1 g cysteine/L water | NF is sterilized by autoclaving. |
| Luria broth + Neutralising solution (LB + NF) | 10 g tryptone + 5 g yeast extract + 10 g NaCl + 30 mL Tween 80 + 30 g saponine + 1 g histidine + 1 g cysteine/L water | LB + NF is sterilized by autoclaving. |
| Sterile desalted water | | |
| Bovine albumin solution | 3% BSA | Sterilized by means of Millipore filter. Used with other liquids in final concentration of 0.3% BSA |
| Incubator 37° C. | | |
| Stopwatch | | |
| Vortex mixer | | |
| Variable pipette and sterile tips | | |
| 100 mm Petri dishes | | |
| 300 ml Flasks | | |

Test Organisms

*Escherichia coli* K12 O Rough H48

The test organism was kept on LBA plates at 4° C. One colony was used to inoculate a 100 ml Flask of LB and incubated at 37° C. for 16 hours to reach stationary phase. For log phase cultures, 4 ml LB were inoculated with one colony and incubated at 37° C. for 16 hours. 1 ml of the bacterial suspension was then added to 100 ml LB and grown to an $OD_{600}$ of approximately 0.375. Serial dilutions of each organism were then performed using LB and plated onto LBA plates to determine the number of colony forming units per ml.

Validation of Test Conditions

1. Validation of Selected Experimental Conditions 1 ml of Bovine Albumin solution (BSA) was placed in a test tube with 1 ml of bacterial test suspension containing approximately $3.0\times10^8$ cfu/ml and incubated at the test temperature of 20° C. for 2 minutes. At the end of this time 8 ml of LB was added. This mixture was incubated for the test contact time of 10 minutes. The solution was then diluted to $3.0\times10^3$ and $3.0\times10^2$ cfu/ml. 0.1 ml of these test solutions were pipetted in triplicate and plated on 12-15 mls of LBA, which is equivalent to $3.0\times10^2$ and $3.0\times10^1$ cfu. The plates were incubated at 37° C. for 24 hours.

Test result should be equal to or greater than 0.05 times bacterial suspension.

2. Neutraliser Toxicity Validation 9 ml of Neutraliser (NF) was placed in a test tube and mixed with 1 ml of a bacterial suspension containing approximately $3.0\times10^8$ cfu/ml. The mixture was incubated at 20° C. for 10 minutes. The suspension was diluted to $3.0\times10^3$ and $3.0\times10^2$ cfu/ml using LBA. 0.1 ml was then pipetted onto triplicate plates containing 12-15 mls of LBA. The plates were incubated at 37° C. for 24 hours.

Test result should be equal to or greater than 0.05 times bacterial suspension

3. Dilution-Neutralisation Validation 1 ml of Bovine albumin solution (BSA) was placed in a test tube with 1 ml of LB and incubated at 20° C. for 5 minutes. 1 ml was then taken and added to 8 ml Neutraliser (NF). After 5 minutes incubation, 1 ml of the bacterial suspension was added. The mixture was left at 20° C. for 10 minutes. The suspension was diluted to $3.0\times10^3$ and $3.0\times10^2$ cfu/ml using LB and 0.1 ml was then plated in triplicate onto 12-15 mls of LBA. The plates were incubated at 37° C. for 24 hours.

Test result should be equal to or greater than 0.5 times of Neutraliser Toxicity Validation.

Test Method

The selected conditions for the tests were:

Temperature: 20° C.

Contact Time: 2 min

Interfering Substance: Bovine Albumin Solution (0.3%)

Product test solution: Byotrol product G5 (0.5% (v/v), diluted with drinking water) plus indicated surfactants/surfactant mixtures, pH is adjusted as indicated.

1 ml BSA was added to 1 ml of bacterial test suspension (approximately $3\times10^8$ cfu/ml) and incubated at 20° C. for 5 minutes. At the end of this time 8 ml of the product test solution was added. After a contact time of 2 minutes, a 1 ml aliquot was pipetted into 9 ml neutraliser (NF). 1 ml of this mixture was used for serial dilutions (LB+NF): $10^{-1}$, $10^{-2}$, $10^{-3}$, $10^{-4}$, $10^{-5}$, $10^{-6}$ and $10^{-7}$. 1 mL of serial dilutions was plated in duplicate into a petri dish with 12-15 mls of LBA.

Using this test procedure, compositions which have anti-microbial efficacy can be identified. Compositions are considered to have anti-microbial efficacy if, in this test, they give a reduction in the number of micro-organisms which is at least about log 5.0. This is in accordance with the European standard (1276) for suspension tests. Compositions having anti-microbial efficacy can be considered to be those that when subjected to this test provide a reduction in the number of micro-organisms of at least about log 5.0 to total kill or zero survivors. Preferably an anti-microbial composition provides a reduction in the number of micro-organisms of at least about log 6.0 more preferably about 7.0 or more under the test conditions described above. Most preferably an anti-microbial composition provides substantially zero survivors or substantially total kill under the test conditions described above.

2. Residual Efficacy Testing Using *Escherichia coli* K12 O Rough H48

The aim of the test is to evaluate the residual efficacy of products of the invention against *Escherichia coli* K12 O Rough H48 using typical household conditions.

| Media and Materials | | |
|---|---|---|
| Luria broth (LB) | 10 g tryptone + 5 g yeast extract + 10 g NaCl/L water | LB is sterilized by autoclaving. |
| Luria broth Aga (LBA) | 15 g agar + 10 g tryptone + 5 g yeast extract + 10 g NaCl/L water | LBA is sterilized by autoclaving. |
| Neutralising solution (NF) | 30 mL Tween 80 + 30 g saponine + 1 g histidine + 1 g cysteine/L water | NF is sterilized by autoclaving. |
| Luria broth + Neutralising solution (LB + NF) | 10 g tryptone + 5 g yeast extract + 10 g NaCl + 30 mL Tween 80 + 30 g saponine + 1 g histidine + 1 g cysteine/L water | LB + NF is sterilized by autoclaving. |
| Sterile desalted water | | |
| Bovine albumin solution | 3% BSA | Sterilized by means of Millipore filter. Used with other liquids in final concentration of 0.3% BSA |
| Incubator 37° C. | | |
| Stopwatch | | |
| Ceramic tiles, glazed (10 cm × 10 cm) | | |
| Professional Care Wipes, viskose free | | |
| Drigalsky spatula | | |
| Vortex mixer | | |
| Variable pipette and sterile tips | | |
| 100 mm Petri dishes | | |
| 300 ml Flasks | | |

Test Organisms

*Escherichia coil* K12 O Rough H48

The test organism was kept on LBA plates at 4° C. One colony was used to inoculate a 100 ml Flask of LB and incubated at 37° C. for 16 hours to reach stationary phase. For log phase cultures, 4 ml LB were inoculated with one colony and incubated at 37° C. for 16 hours. 1 ml of the bacterial suspension was then added to 100 ml LB and grown to an $OD_{600}$ of approximately 0.375. Serial dilutions of each organism were then performed using LB and plated onto LBA plates to determine the number of colony forming units per ml.

Validation of Test Conditions

1. Validation of Selected Experimental Conditions 1 ml of Bovine Albumin solution (BSA) was placed in a test tube with 1 ml of bacterial test suspension containing approximately $3.0\times10^8$ cfu/ml and incubated at the test temperature of 20° C. for 2 minutes. At the end of this time 8 ml of LB was added. This mixture was incubated for the test contact time of 10 minutes. The solution was then diluted to $3.0\times10^3$ and $3.0\times10^2$ cfu/ml. 0.1 ml of these test solutions were pipetted in triplicate and plated on 12-15 mls of LBA, which is equivalent to $3.0\times10^2$ and $3.0\times10^1$ cfu. The plates were incubated at 37° C. for 24 hours.

Test result should be equal to or greater than 0.05 times bacterial suspension.

2. Neutraliser Toxicity Validation 9 ml of Neutraliser (NF) was placed in a test tube and mixed with 1 ml of a bacterial suspension containing approximately $3.0\times10^8$ cfu/ml. The mixture was incubated at 20° C. for 10 minutes. The suspension was diluted to $3.0\times10^3$ and $3.0\times10^2$ cfu/ml using LBA. 0.1 ml was then pipetted onto triplicate plates containing 12-15 mls of LBA. The plates were incubated at 37° C. for 24 hours.

Test result should be equal to or greater than 0.05 times bacterial suspension

3. Dilution-Neutralisation Validation 1 ml of Bovine albumin solution (BSA) was placed in a test tube with 1 ml of LB and incubated at 20° C. for 5 minutes. 1 ml was then taken and added to 8 ml Neutraliser (NF). After 5 minutes incubation, 1 ml of the bacterial suspension was added. The mixture was left at 20° C. for 10 minutes. The suspension was diluted to $3.0\times10^3$ and $3.0\times10^2$ cfu/ml using LB and 0.1 ml was then plated in triplicate onto 12-15 mls of LBA. The plates were incubated at 37° C. for 24 hours.

Test result should be equal to or greater than 0.5 times of Neutraliser to Toxicity Validation.

Test Method

1. Pretreatment of Carrier

Carriers were cleaned/disinfected with isopropanol (70% v/v) by spraying. Excess isopropanol was used to cover the entire surface completely. Excess isopropanol was removed by running off. Further drying was allowed for a period of 10 minutes.

2. $1^{st}$ Inoculation of Carrier $1^{st}$ challenge of tile surface with ~$10^6$ CFU bacteria. Application volume is set at 10 μL. If residual amounts of isopropanol remain some of applied bacteria might be killed. The applied volume of 10 μL was spread over entire tile surface by means of sterile plastic spatula (Drigalsky spatula). Challenged tile is allowed to dry over a period of 50 minutes.

3. Product Application to Carrier 1 mL of disinfecting product was applied to a pretreated carrier surface. Applied disinfecting product was spread over entire surface by means of sterile plastic spatula (Drigalsky spatula). Surface treatment with excess disinfecting product was done over a period of 10 minutes. Pretreated carriers were stored overnight in a clean place, covered with Professional Care Wipes.

4. Inoculation of Carrier

Inoculation of tile surface was done by using ~$10^6$ CFU bacteria. Application volume was set at 10 μL. If residual amounts of isopropanol remain some of applied bacteria might be killed. The applied volume of 10 μL was spread over entire tile surface by means of sterile plastic spatula (Drigalsky spatula). Challenged tile was allowed to dry over a period of 50 minutes.

5. Rinsing with Water

Tile surface was rinsed with 10 mL sterile water ($water_{millipored}$). After rinsing tile was dried for up to 1 hr or till surface was visibly dry.

6. Dry Wear Cycle

Wear cycles are used as an abrasive step. A dry wear cycle was done by moving a cork block wrapped with Professional Care Wipe back and forth. Normal hand pressure is applied. Professional Care Wipes of non viscose type, do not adsorb quats or PHMB.

7. Wet Wear Cycle

Wetting of Professional Care Wipes was done by spraying $water_{millipored}$ onto wipes. Spraying was done by triggering one time from about 30 cm. Wet wear cycles were used as an abrasive step. A Wet wear cycle was done by moving a cork block wrapped with wetted ($water_{millipored}$) Professional Care Wipe back and forth. Normal hand pressure was applied. The wetted surface was allowed to dry for at least 10 minutes.

8. Final Inoculation of Carrier

The tile is challenged with ~$10^6$ CFU bacteria. The application volume was set at 10 μL. The applied volume was spread over entire tile surface by means of sterile plastic spatula (Drigalsky spatula). The challenged tile was allowed to dry over a period of 5 to 10 minutes. Surviving bacteria were dissolved by applying 500 μL LB+NF. The applied LB+NF was spread over entire tile surface by means of sterile plastic spatula (Drigalsky spatula, single use version). The neutralizer had no killing effect on surviving bacteria, but inactivates the disinfecting product on tiles. To dissolve surviving bacteria the tile was incubated at room temperature for 30 minutes. Dissolved surviving bacteria were collected by means of sterile plastic spatula (Drigalsky spatula).

9. Determination of Survivors

The collected liquid was sampled by means of a sterile pipette. 100 μL of sample was applied to 900 μL of LB+NF. Serial dilution in LB+NF up to $10^{-4}$ 100 μL of sample was carried out and the dilutions are transferred to agar plates.

Test Method - Total Procedure

| # | DAY | PROCEDURE |
|---|---|---|
| 1 | 1 | Preparation of bacteria culture (overnight culture) |
| 2 | | Pretreatment of carrier (tiles); see Step 1 |
| 3 | 2 | 1st Inoculation of Carrier; see Step 2 |
| 4 | | Product Application to Carrier; see Step 3 |
| 5 | | Wet wear cycle; see Step 7 |
| 6 | 3 | Dry wear cycle;; see Step 6 |
| 7 | | Rinsing with water$_{millipored}$; see Step 5 |
| 8 | | Inoculation of carrier; see Step 4 |
| 9 | 4 | Dry wear cycle; see Step 6 |
| 10 | | Final inoculation of carrier; see Step 8 |
| 11 | 5 | Determination of survivors; see Step 10 |

This test procedure uses $10^8$ CFU/mL. This means that of log 8 reduction in the number of micro-organisms is equivalent to zero survivors.

Using this test procedure, compositions which have a residual efficacy can be identified. Anti-microbial compositions are considered to have residual efficacy if, in this test, they give a reduction in the number of micro-organisms which is at least log 3.0. Preferably an anti-microbial composition having a residual effect and tested in this manner will give a log reduction of at least about 3.5, more preferably at least about 5.0 and most preferably about 7.0 or more under the test conditions described above.

The invention will now be illustrated by the following non-limiting examples.

EXAMPLES

The following are representative of antimicrobial compositions in accordance with the present invention.

Example 1

| Component | Composition wt % |
|---|---|
| Coco alkyl dimethyl benzyl ammonium chloride | 0.1 |
| di-n-decyl dimethyl ammonium chloride | 0.092 |
| Bronopol (INN) | 0.074 |
| Polymeric biguanidine hydrochloride | 0.042 |
| mixture of hexamethyldisiloxane, octamethyltrisiloxane | 0.0017 |
| Ethanol | 0.15 |
| Water | 99.54 |

The mixture of hexamethyldisiloxane, octamethyltrisiloxane having a viscosity of 0.65 centistokes, is available from Clearcoproducts prod ref PS 034 (http://www.clearcoproducts.com/pdf/volatile/NP-PSF-0 65cSt.pdf)

This composition was obtained by initially mixing (with slow addition) the two ammonium chloride compounds, Bronopol, polymeric biguanidine hydrochloride and the mixture of hexamethyldisiloxane and octamethyltrisiloxane with stirring at room temperature until the initially cloudy mixture became clear. The ethanol and water were then added.

The amounts of ethanol water added in this Example resulted in the production of a solution that was "ready use" for many applications, although it could be diluted further for some applications, if necessary.

Example 2

The compositions shown in the table below were diluted with water to provide solutions comprising 0.01% of the composition (E4L or E52 or E8L or E10L) and 99.99% water)

| | | E4L | E5L | E8L | E10L |
|---|---|---|---|---|---|
| Acticide BAC50 | Cocoalkyl dimethylbenzyl ammonium Cl | 31.64 | 30.18 | 15.25 | 15.11 |
| Acticide 50X | BAC50 + 2-phenyl phenol | 6.21 | 5.95 | 2.71 | |
| Acticide DDQ | Didecyldimethyl ammonium Cl | | | 21.01 | 20.82 |
| Acticide L30 | Bronopol | | | 6.69 | 9.94 |
| Acticide MBS | BIT + MIT 1:1 | | 17.25 | 5.78 | 5.72 |
| Acticide 14 | Chloro MIT + MIT 3:1 | 21.13 | | 0.69 | 0.68 |
| Acticide DW | OIT | 6.08 | 5.75 | 2.65 | 2.63 |
| Acticide PHB20 | Poly hexamethylene biguanide | | | 8.66 | 8.59 |
| JD003 | 10% silicone in butyl acetate | 1.72 | 1.64 | 1.80 | 1.79 |
| Solvent | Iso propanol | 33.21 | 39.22 | 34.76 | |
| Solvent | TSDA2 denatured ethanol | | | | 34.71 |
| | Totals (part by weight) | 100 | 100 | 100 | 100 |

BIT 1,2-benzisothiazol-3(2H)-one
MIT 2-methyl-2H-isothiazol-3-one
Chloro MIT 5-chloro-2-methyl-4-isothiazolin-3-one
OIT 2-octyl-2H-isothiazol-3-one The diluted solutions were added to a broth containing a known amount of the microorganisms *staphylococcus aureus, salmonella, Escherichia coli, Pseudomonas aeroginosa* and *Listeria monocytogenes* in a nutrient medium. The amount of microorganisms present in the solutions was measured at 30 second, 1 minute, 3 minutes and 5 minutes after addition of the diluted compositions of the invention. This was done by neutralizing the anti-microbial components of the solutions by addition of a suitable neutralizing agent and then determining the number of microoganisms present.

In the tables below, the percentage of microorganisms that were killed after a given contact time is shown for each diluted anti-microbial solution.

Results - E4L

| | Contact time | | | |
|---|---|---|---|---|
| Organism tested | 30 sec | 1 min | 3 min | 5 min |
| *Staphylococcus aureus* | 99.70% | 99.9% | 99.9% | 99.9% |
| *Salmonella* | 99.9% | 99.9% | 99.9% | 99.9% |
| *Escherichia coli* | 98.75% | 99.50% | 99.9% | 99.9% |

-continued

Results - E4L

| Organism tested | Contact time 30 sec | 1 min | 3 min | 5 min |
|---|---|---|---|---|
| *Pseudomonas aeroginosa* | 86.96% | 98.76% | 99.9% | 99.9% |
| *Listeria monocytogenes* | 99.00% | 99.9% | 99.9% | 99.9% |

Results - E8L

| Organism tested | Contact time 30 sec | 1 min | 3 min | 5 min |
|---|---|---|---|---|
| *Staphylococcus aureus* | 99.9% | 99.9% | 99.9% | 99.9% |
| *Salmonella* | 99.9% | 99.9% | 99.9% | 99.9% |
| *Escherichia coli* | 97.50% | 99.9% | 99.9% | 99.9% |
| *Pseudomonas aeroginosa* | 97.86% | 99.9% | 99.9% | 99.9% |
| *Listeria monocytogenes* | 99.80% | 99.80% | 99.9% | 99.9% |

Result - E5L

| Organism tested | Contact time 30 sec | 1 min | 3 min | 5 min |
|---|---|---|---|---|
| *Staphylococcus aureus* | 98.55% | 99.9% | 99.9% | 99.9% |
| *Salmonella* | 99.70% | 99.90% | 99.9% | 99.9% |
| *Escherichia coli* | 98.90% | 99.20% | 99.60% | 99.90% |
| *Pseudomonas aeroginosa* | 98.36% | 98.46% | 99.9% | 99.9% |
| *Listeria monocytogenes* | 99.60% | 99.9% | 99.9% | 99.9% |

Results -E10L

| Organism tested | Contact time 30 sec | 1 min | 3 min | 5 min |
|---|---|---|---|---|
| *Staphylococcus aureus* | 99.9% | 99.9% | 99.9% | 99.9% |
| *Salmonella* | 99.70% | 99.90% | 99.9% | 99.9% |
| *Escherichia coli* | 98.20% | 99.70% | 99.9% | 99.9% |
| *Pseudomonas aeroginosa* | 99.16% | 99.54% | 99.9% | 99.9% |
| *Listeria monocytogenes* | 99.9% | 99.9% | 99.9% | 99.9% |

These results show that even at this low concentration the formulations tested had anti-microbial efficacy.

The invention claimed is:

1. An anti-microbial composition comprising (i) an antimicrobial agent with surfactant properties, wherein the antimicrobial agent is a quaternary ammonium compound having the formula $R_1R_2R_3R_4N^+X^-$, wherein $R_1$, $R_2$, $R_3$ and $R_4$ represent, independently a substituted or unsubstituted and/or straight chain or branched and/or interrupted or uninterrupted alkyl, aryl, alkylaryl, arylalkyl, cycloalkyl, heterocyclyl or alkenyl group or two or more of $R_1$, $R_2$, $R_3$ and $R_4$ together with the nitrogen atom form a substituted or unsubstituted heterocyclic ring, and wherein the total number of carbon atoms in the groups $R_1$, $R_2$, $R_3$ and $R_4$ is at least 4;

wherein the substituents for the groups $R_1$, $R_2$, $R_3$ and $R_4$ are selected from the group consisting of alkyl, substituted alkyl, alkenyl, substituted alkenyl, heterocyclyl, substituted heterocyclyl, cycloalkyl, substituted cycloalkyl, aryl, substituted aryl, alkylaryl, substituted alkylaryl, arylalkyl, substituted arylalkyl, F, Cl, Br, I, —OR', —NR'R", —$CF_3$, —CN, —$NO_2$, —$C_2$R', —SR', —$N_3$, —C(=O)NR'R", —NR'C(=O) R", —C(=O)R', —C(=O)OR', —OC(=O)R', —O(CR'R")$_r$C(=O)R', —O(CR'R")$_r$NR"C(=O)R', —O(CR'R")$_r$NR'$SO_2$R', —OC(=O)NR'R", —NR'C(=O)OR", —$SO_2$R', —$SO_2$NR'R", and —NR'$SO_2$R";

wherein R' and R" are individually hydrogen, $C_1$-$C_8$ alkyl, cycloalkyl, heterocyclyl, aryl, or arylalkyl, and r is an integer from 1 to 6, or R' and R" together form a cyclic functionality;

wherein the term "substituted" as applied to alkyl, alkenyl, heterocyclyl, cycloalkyl, aryl, alkylaryl and arylalkyl refers to the substituents described above, starting with F and ending with —NR'$SO_2$R";

and wherein if each $R_1$, $R_2$, $R_3$ and $R_4$ is an unsubstituted or uninterrupted alkyl, each of $R_1$, $R_2$, $R_3$ and $R_4$ is independently methyl or a $C_{6-12}$ alkyl group;

and wherein $X^-$ is halide or sulphonate;

(ii) a siloxane selected the group consisting of from those having the formula $(H_3C)[SiO(CH_3)_2]_nSi(CH_3)_3$, and $(H_3C)[SiO(CH_3)H]_nSi(CH_3)_3$, and mixtures thereof, wherein n is from 1 to 24; and (iii) a polar solvent; wherein the ratio of molecules of (i) to molecules of (ii) is from about 100:1 to about 5:1; and (iv) at least one additional anti-microbial agent selected from the group consisting of polymeric biguanides, isothiazalones, ortho phenyl phenol, nitro bromopropanes and polymerised quaternary ammonium compounds.

2. A composition according to claim 1, wherein the ratio of molecules of (i) to molecules of (ii) is from about 70:1 to about 20:1.

3. A composition according to claim 1, wherein in the formula $(H_3C)[SiO(CH_3)_2]_nSi(CH_3)_3$ and $(H_3C)[SiO(CH_3)H]_nSi(CH_3)_3$, n is from 1 to 12.

4. A composition according to claim 1, wherein the siloxane has a viscosity of from about 0.5 to about 5 centistokes.

5. A composition according to claim 1, comprising colloids which are made up of components (i), (ii) and optionally (iv).

6. A composition according to claim 1 wherein the quaternary ammonium compound has the formula $(CH_3)_n(A)_mN^+X^-$, wherein each A is independently as defined for $R_1$, $R_2$, $R_3$ and $R_4$, n is from 1 to 3, and m is from 1 to 3, provided that the sum of n and m is 4.

7. A composition according to claim 6 wherein each A is independently a $C_{6-12}$ substituted or unsubstituted and/or straight chain or branched and/or interrupted or uninterrupted alkyl, aryl, alkylaryl, arylalkyl or cycloalkyl group.

8. A composition according to claim 6 wherein each A is independently a $C_{6-12}$ substituted or unsubstituted and/or straight chain or branched and/or interrupted or uninterrupted alkyl, aryl, alkylaryl group.

9. A composition according to claim 8 wherein the quaternary ammonium compound is dodecyltrimethylammonium bromide.

10. A composition according to claim 7 wherein n=2 and m=2 and each A is the same or different and is a straight chain, unsubstituted and uninterrupted $C_{6-12}$ alkyl group or a benzyl group.

11. A composition according to claim 1 wherein the quaternary ammonium compound is a benzalkonium halide or an aryl ring substituted derivative thereof.

12. A composition according to claim 11 wherein the benzalkonium halide has the formula:

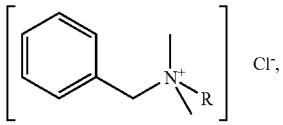

wherein R is as defined for $R_1$, $R_2$, $R_3$ and $R_4$.

13. A composition according to claim 12 wherein R is a $C_{8-18}$ alkyl group or a mixture of $C_{8-18}$ alkyl groups.

14. A composition according to claim 13 wherein R is a mixture of straight chain, unsubstituted and uninterrupted $C_{8-18}$ alkyl groups.

15. A composition according to claim 1 wherein one or more of $R_1$, $R_2$, $R_3$ and $R_4$ is interrupted by a heteroatom selected from oxygen, nitrogen, sulphur, and a phosphorus-containing moiety.

16. A composition according to claim 15, wherein the quaternary ammonium compound is selected from domiphen bromide and benzethonium chloride.

17. A composition according to claim 1, wherein the quaternary ammonium compound is selected from benzyldimethyl-n-tetradecyl-ammonium chloride, benzyldimethyl-n-dodecyl-ammonium chloride, benzyl-$C_{12}$-$C_{16}$-alkyl-dimethyl-ammonium chloride, benzyl-cocoalkyl-dimethyl-ammonium chloride, di-n-decyldimethylammonium chloride, and mixtures thereof.

18. A composition according to claim 1 wherein the siloxane has a solubility in water of less than 2 g/100 ml water at 20° C. and atmospheric pressure and/or a viscosity of from 0.5 to 5 centistokes.

19. A composition according to claim 1 wherein the siloxane is selected from hexamethyl disiloxane, octamethyl trisiloxane, decamethyl tetrasiloxane, dodecamethyl pentasiloxane and mixtures thereof.

20. A composition according to claim 1 wherein the polar solvent is selected the group consisting of from water, alcohols, esters, hydroxy and glycol esters, polyols and ketones, and mixtures thereof.

21. A composition according to claim 20 wherein the polar solvent is selected the group consisting of from water, ethanol, n-propanol, isopropanol, diethylene glycol and dipropylene glycol and mixtures thereof.

22. A composition according to claim 1 wherein the additional anti-microbial agent is polyhexamethylene biguanidine.

23. A composition according to claim 1, wherein the ratio of molecules of component (i) to molecules of component (iv) is from 8:1 to 15:1.

24. A composition according to claim 1 wherein the total number of molecules of the anti-microbial components (i) and (iv) to every molecule of component (ii) is from about 5 to about 80.

25. A composition according to claim 1 which on application to a surface acts to substantially reduce or control the formation of microbial colonies on or at the surface.

26. A composition according to claim 1 which provides an anti-microbial effect when the total concentration of anti-microbial agents (i) and (iv) is from about 30 to less than about 400 ppm.

27. A process for preparing a composition according to claim 1 comprising (A) mixing together (i) an anti-microbial agent with surfactant properties, wherein the antimicrobial agent is a quaternary ammonium compound having the formula $R_1R_2R_3R_4N^+X^-$, wherein $R_1$, $R_2$, $R_3$ and $R_4$ represent, independently a substituted or unsubstituted and/or straight chain or branched and/or interrupted or uninterrupted alkyl, aryl, alkylaryl, arylalkyl, cycloalkyl, heterocyclyl or alkenyl group or two or more of $R_1$, $R_2$, $R_3$ and $R_4$ together with the nitrogen atom form a substituted or unsubstituted heterocyclic ring, and wherein the total number of carbon atoms in the groups $R_1$, $R_2$, $R_3$ and $R_4$ is at least 4;

wherein the substituents for the groups $R_1$, $R_2$, $R_3$ and $R_4$ are selected from the group consisting of alkyl, substituted alkyl, alkenyl, substituted alkenyl, heterocyclyl, substituted heterocyclyl, cycloalkyl, substituted cycloalkyl, aryl, substituted aryl, alkylaryl, substituted alkylaryl, arylalkyl, substituted arylalkyl, F, Cl, Br, I, —OR', —NR'R", —$CF_3$, —CN, —$NO_2$, —$C_2$R', —SR', —$N_3$, —C(=O)NR'R", —NR'C(=O) R", —C(=O)R', —C(=O)OR', —OC(=O)R', —O(CR'R")$_r$C(=O)R', —O(CR'R")$_r$NR"C(=O)R', —O(CR'R")$_r$NR"$SO_2$R', —OC(=O)NR'R", —NR'C(=O)OR", —$SO_2$R', —$SO_2$NR'R", and —NR'$SO_2$R";

wherein R' and R" are individually hydrogen, $C_1$-$C_8$ alkyl, cycloalkyl, heterocyclyl, aryl, or arylalkyl, and r is an integer from 1 to 6, or R' and R" together form a cyclic functionality;

wherein the term "substituted" as applied to alkyl, alkenyl, heterocyclyl, cycloalkyl, aryl, alkylaryl and arylalkyl refers to the substituents described above, starting with F and ending with —NR'$SO_2$R";

and wherein if each of $R_1$, $R_2$, $R_3$ and $R_4$ is an unsubstituted or uninterrupted alkyl, each of $R_1$, $R_2$, $R_3$ and $R_4$ is independently methyl or a $C_{6-12}$ alkyl group;

and wherein $X^-$ is halide or sulphonate; and (ii) a siloxane selected from those having the formula $(H_3C)[SiO(CH_3)_2]_nSi(CH_3)_3$ and $(H_3C)[SiO(CH_3)H]_nSi(CH_3)_3$ and mixtures thereof wherein n is from 1 to 24; and (B) adding (iii) a polar solvent to the product of (A) and (C) agitating the resulting mixture until a clear solution is formed; and wherein at least one additional anti-microbial agent which is selected from the group consisting of polymeric biguanidines, isothiazalones, ortho phenyl phenol, nitro bromopropanes, and polymerised quaternary ammonium compounds is added during step (A) or step (B) or step (C).

28. A process of claim 27 wherein in step (A), component (ii) is mixed with a concentrated solution of component (i) in a polar solvent.

29. A process of claim 27 wherein the agitation of step (C) comprises sonication and/or stirring.

30. A composition obtainable by a process as defined in claim 27.

31. An anti-microbial composition according to claim 1, wherein the anti-microbial agent with surfactant properties comprises octyldecyldimethylammonium chloride, didecyldimethylammonium chloride, dioctyldimethylammonium chloride and alkyldimethylbenzylammonium chloride.

* * * * *